US008000616B2

(12) United States Patent
Teshima et al.

(10) Patent No.: US 8,000,616 B2
(45) Date of Patent: Aug. 16, 2011

(54) IMAGE FORMING APPARATUS

(75) Inventors: Eiichiro Teshima, Ashigarakami-gun (JP); Tatsuto Tachibana, Numazu (JP); Ryuichi Yoshizawa, Yokohama (JP); Kazuhisa Maruyama, Sagamihara (JP); Atsuya Takahashi, Mishima (JP); Akihiro Nakamura, Mishima (JP); Kaoru Sato, Minamiashigara (JP)

(73) Assignee: Canon Kabushiki Kaisha, Tokyo (JP)

( * ) Notice: Subject to any disclaimer, the term of this patent is extended or adjusted under 35 U.S.C. 154(b) by 685 days.

(21) Appl. No.: 11/759,821

(22) Filed: Jun. 7, 2007

(65) Prior Publication Data

US 2007/0286614 A1 Dec. 13, 2007

(30) Foreign Application Priority Data

Jun. 13, 2006 (JP) ..... 2006-163823

(51) Int. Cl.
*G03G 15/00* (2006.01)
*B41J 11/44* (2006.01)

(52) U.S. Cl. ..... 399/16; 400/76

(58) Field of Classification Search ..... 399/16
See application file for complete search history.

(56) References Cited

U.S. PATENT DOCUMENTS

| | | | | |
|---|---|---|---|---|
| 5,043,770 | A * | 8/1991 | Nagano et al. | 399/392 |
| 5,321,486 | A * | 6/1994 | Nanbu et al. | 399/14 |
| 6,543,685 | B1 * | 4/2003 | Lien et al. | 235/380 |
| 2006/0158501 | A1 * | 7/2006 | Itoh | 347/104 |

FOREIGN PATENT DOCUMENTS

| | | | |
|---|---|---|---|
| JP | 08223352 | A * | 8/1996 |
| JP | 2001-088370 | A | 4/2001 |
| JP | 2001166646 | A * | 6/2001 |
| JP | 2003-026365 | A | 1/2003 |
| JP | 2003-040468 | A | 2/2003 |
| JP | 2006135669 | A * | 5/2006 |

* cited by examiner

*Primary Examiner* — Matthew G Marini
*Assistant Examiner* — Allister Primo
(74) *Attorney, Agent, or Firm* — Canon USA, Inc. IP Div

(57) ABSTRACT

An image forming apparatus to which a paper handling unit is connected thereto is provided. The image forming apparatus detects the size of a sheet in a direction in which the sheet is conveyed for image formation. The image forming apparatus outputs sheet size mismatch information indicating that the size of the sheet does not match a predetermined size to the paper handling unit before a size detecting operation thereof has been completed detecting the trailing edge of the sheet is greater than the predetermined size.

3 Claims, 21 Drawing Sheets

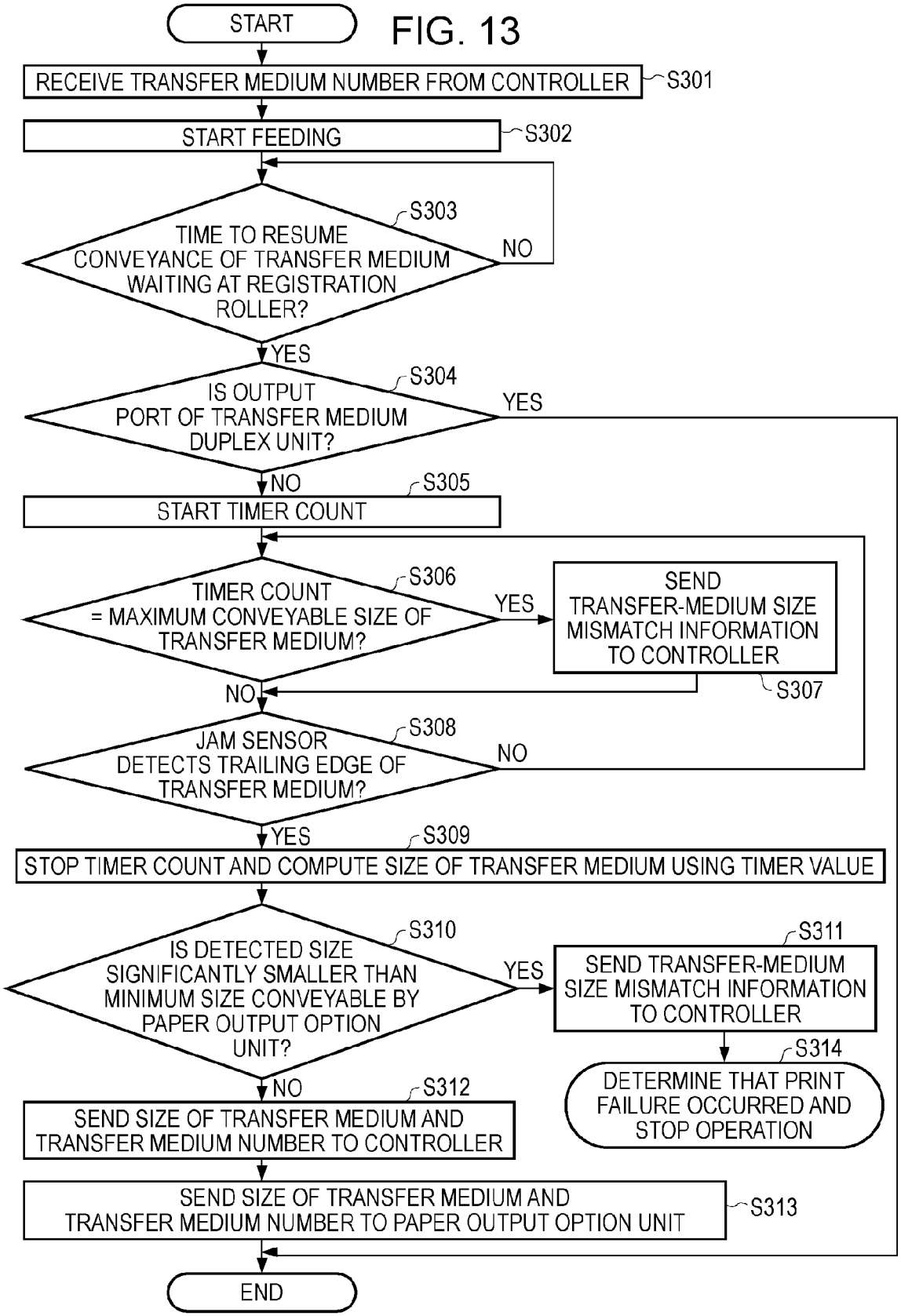
START
FIG. 13
RECEIVE TRANSFER MEDIUM NUMBER FROM CONTROLLER
S301
START FEEDING
S302
S303
TIME TO RESUME CONVEYANCE OF TRANSFER MEDIUM WAITING AT REGISTRATION ROLLER?
NO
YES
S304
IS OUTPUT PORT OF TRANSFER MEDIUM DUPLEX UNIT?
YES
NO
S305
START TIMER COUNT
S306
TIMER COUNT = MAXIMUM CONVEYABLE SIZE OF TRANSFER MEDIUM?
YES
SEND TRANSFER-MEDIUM SIZE MISMATCH INFORMATION TO CONTROLLER
S307
NO
S308
JAM SENSOR DETECTS TRAILING EDGE OF TRANSFER MEDIUM?
NO
YES
S309
STOP TIMER COUNT AND COMPUTE SIZE OF TRANSFER MEDIUM USING TIMER VALUE
S310
IS DETECTED SIZE SIGNIFICANTLY SMALLER THAN MINIMUM SIZE CONVEYABLE BY PAPER OUTPUT OPTION UNIT?
YES
S311
SEND TRANSFER-MEDIUM SIZE MISMATCH INFORMATION TO CONTROLLER
S314
DETERMINE THAT PRINT FAILURE OCCURRED AND STOP OPERATION
NO
S312
SEND SIZE OF TRANSFER MEDIUM AND TRANSFER MEDIUM NUMBER TO CONTROLLER
SEND SIZE OF TRANSFER MEDIUM AND TRANSFER MEDIUM NUMBER TO PAPER OUTPUT OPTION UNIT
S313
END

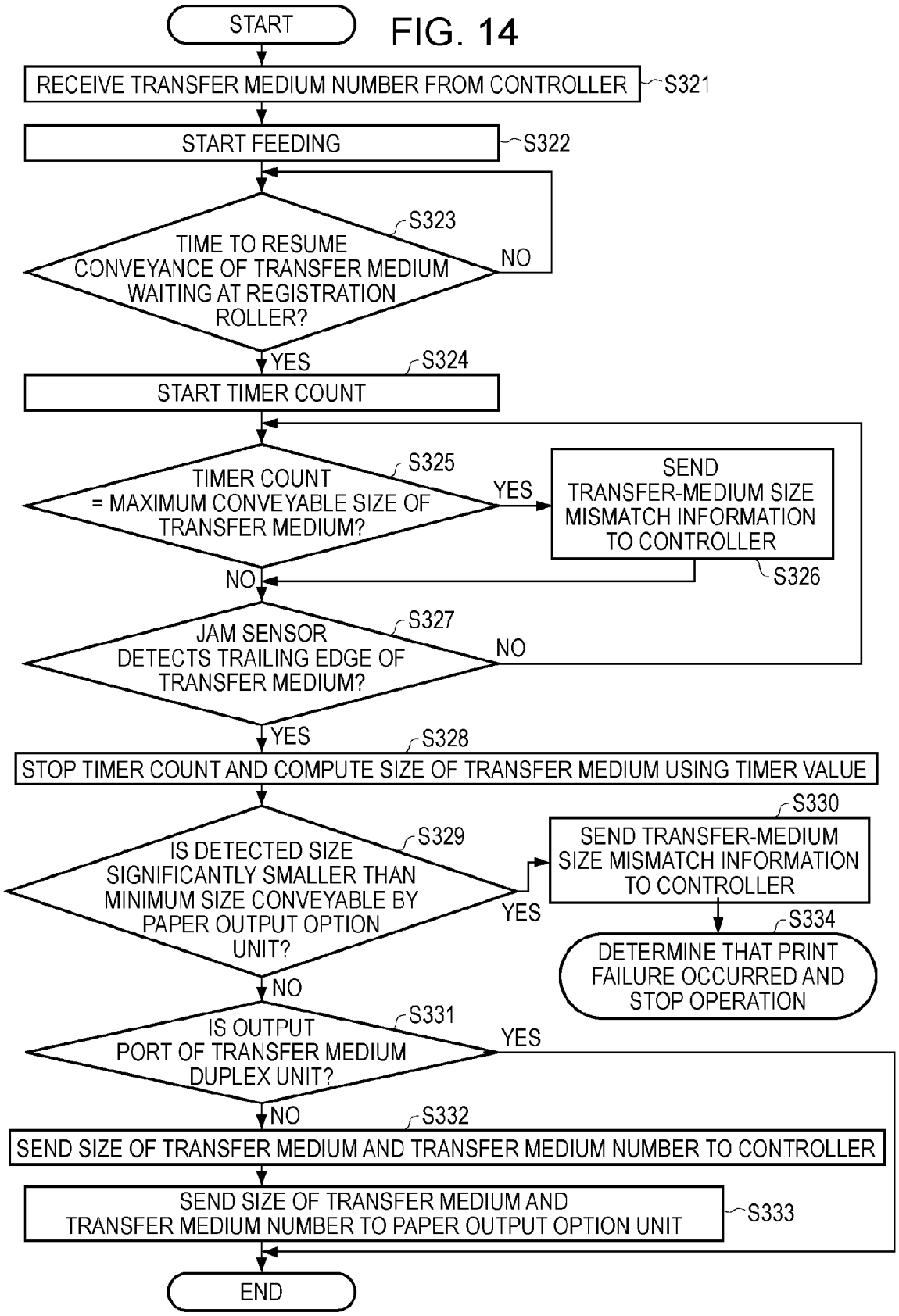
START
FIG. 14
RECEIVE TRANSFER MEDIUM NUMBER FROM CONTROLLER
S321
START FEEDING
S322
S323
TIME TO RESUME CONVEYANCE OF TRANSFER MEDIUM WAITING AT REGISTRATION ROLLER?
NO
YES
S324
START TIMER COUNT
S325
TIMER COUNT = MAXIMUM CONVEYABLE SIZE OF TRANSFER MEDIUM?
YES
SEND TRANSFER-MEDIUM SIZE MISMATCH INFORMATION TO CONTROLLER
S326
NO
S327
JAM SENSOR DETECTS TRAILING EDGE OF TRANSFER MEDIUM?
NO
YES
S328
STOP TIMER COUNT AND COMPUTE SIZE OF TRANSFER MEDIUM USING TIMER VALUE
S329
IS DETECTED SIZE SIGNIFICANTLY SMALLER THAN MINIMUM SIZE CONVEYABLE BY PAPER OUTPUT OPTION UNIT?
YES
S330
SEND TRANSFER-MEDIUM SIZE MISMATCH INFORMATION TO CONTROLLER
S334
DETERMINE THAT PRINT FAILURE OCCURRED AND STOP OPERATION
NO
S331
IS OUTPUT PORT OF TRANSFER MEDIUM DUPLEX UNIT?
YES
NO
S332
SEND SIZE OF TRANSFER MEDIUM AND TRANSFER MEDIUM NUMBER TO CONTROLLER
SEND SIZE OF TRANSFER MEDIUM AND TRANSFER MEDIUM NUMBER TO PAPER OUTPUT OPTION UNIT
S333
END

IMAGE FORMING APPARATUS

BACKGROUND OF THE INVENTION

1. Field of the Invention

The present invention relates to an image forming apparatus that forms an image on a transfer medium (a sheet on which an image is to be recorded) and includes a sheet outputting mechanism for outputting the transfer medium to outside the image forming apparatus.

2. Description of the Related Art

An exemplary configuration of existing image forming apparatuses is described below with reference a laser printer, an example of a multi-color image forming apparatus.

FIG. 15 is a cross-sectional view of an exemplary configuration of an existing image forming apparatus. Components of the image forming apparatus shown in FIG. 15 are described in detail below. FIG. 16 illustrates interface signals between an engine control unit 201 (not shown in FIG. 15) that forms an image in the image forming apparatus shown in FIG. 15 and a controller 202 (not shown in FIG. 15).

As shown in FIG. 16, a serial command transmission signal line 203 is used for serially transmitting a command from the controller 202 to the engine control unit 201. A serial status transmission signal line 204 is used for serially transmitting status data from the engine control unit 201 to the controller 202 in response to the command. A reference vertical synchronizing signal line 205 is used for transmitting a reference vertical synchronizing signal (hereinafter referred to as a "TOP signal") from the engine control unit 201 to the controller 202. A Y horizontal synchronizing signal line 206 is used for transmitting a yellow horizontal synchronizing signal from the engine control unit 201 to the controller 202. An M horizontal synchronizing signal line 207 is used for transmitting a magenta horizontal synchronizing signal from the engine control unit 201 to the controller 202. A C horizontal synchronizing signal line 208 is used for transmitting a cyan horizontal synchronizing signal from the engine control unit 201 to the controller 202. A K horizontal synchronizing signal line 209 is used for transmitting a black horizontal synchronizing signal from the engine control unit 201 to the controller 202. A Y image data signal line 210 is used for transmitting a yellow image data signal from the controller 202 to the engine control unit 201. An M image data signal line 211 is used for transmitting a magenta image data signal from the controller 202 to the engine control unit 201. A C image data signal line 212 is used for transmitting a cyan image data signal from the controller 202 to the engine control unit 201. A K image data signal line 213 is used for transmitting a black image data signal from the controller 202 to the engine control unit 201.

FIG. 17 is a timing diagram illustrating signal timings for the TOP signal, the horizontal synchronizing signals, and the image data when a full color mode is selected.

Upon receipt of a print operation start command from a host computer (not shown), the controller 202 submits a print operation start command to the engine control unit 201 via the serial command transmission signal line 203. Upon receipt of the print operation start command, the engine control unit 201 starts a print operation and transmits a status message indicating that it has started a print operation to the controller 202 via the serial status transmission signal line 204.

When the print operation starts, the engine control unit 201 starts operating photoconductor drums 5Y, 5M, 5C, and 5K, an intermediate transfer belt 12, and scanner units 10Y, 10M, 10C, and 10K shown in FIG. 15 to prepare for forming images of respective colors. As shown in FIG. 17, when the preparation is completed, the engine control unit 201 outputs a TOP signal 301 to the controller 202 via the reference vertical synchronizing signal line 205 in order to provide vertical synchronization for a first color. In this example, images of a yellow color component, a magenta color component, a cyan color component, and a black color component are sequentially formed in this order. The controller 202 outputs yellow image data 303 to the engine control unit 201 via the Y image data signal line 210 in synchronization with the TOP signal 301 and a Y horizontal synchronizing signal 302 output from the engine control unit 201.

The engine control unit 201 primarily transfers, to the intermediate transfer belt 12, a visible image formed on the photoconductor drum 5Y on the basis of the yellow image data 303 delivered from the controller 202. The engine control unit 201 outputs, to the controller 202, a timing at which the yellow toner image transferred onto the intermediate transfer belt 12 passes through the lowest point of the magenta conductive drum 5M. The controller 202 outputs magenta image data 305 to the engine control unit 201 in synchronization with that timing. At that time, the controller 202 outputs the magenta image data 305 to the engine control unit 201 after a predetermined time period T1 (indicated by a reference numeral 304 shown in FIG. 17) has elapsed so that the yellow toner image is located at the lowest point of the magenta conductive drum 5M. The engine control unit 201 performs control so that a primary transfer unit located at the lowest point of the magenta conductive drum 5M primarily transfers the visible image formed on the magenta conductive drum 5M to the intermediate transfer belt 12 exactly at the position of the yellow toner image. Similar operations are performed for cyan and black toner images. At that time, the operations are performed so that the images of the four colors exactly overlap. That is, as shown in FIG. 17, the controller 202 starts generating cyan image data 307 and black image data 309 after predetermined time periods T2 (indicated by a reference numeral 306) and T3 (indicated by a reference numeral 308) have elapsed from the time the TOP signal is output, respectively. In addition, the engine control unit 201 forms images corresponding to the image data on the intermediate transfer belt 12.

As noted above, in the color laser printer, under the control of the engine control unit 201, an image forming unit forms electrostatic latent images using imaging light beams generated on the basis of image signals transmitted from the controller 202. The image forming unit then develops the electrostatic latent images into visible images, which are overlapped and transferred. Thus, a color visible image is formed. The image forming unit transfers this color visible image onto a transfer medium 2 shown in FIG. 15. Subsequently, the image forming unit fixes the color visible image onto a transfer medium 2.

As shown in FIG. 15, the image forming unit includes the photoconductor drums 5Y, 5M, 5C, and 5K for stations of the respective colors arranged in parallel. The image forming unit further includes injection charging units 7Y, 7M, 7C, and 7K serving as primary charging units. Furthermore, the image forming unit includes developing units 8Y, 8M, 8C, and 8K, toner cartridges 11Y, 11M, 11C, and 11K, the intermediate transfer belt 12, a sheet feeder unit, a transfer unit, and a fixing unit 13.

The photoconductor drums (photosensitive members) 5Y, 5M, 5C, and 5K are each composed of an aluminum cylinder having an organic photoconductive layer applied on the outer periphery thereof. The photoconductor drums 5Y, 5M, 5C, and 5K are rotated by driving forces transferred from driving motors (not shown). As shown in FIG. 15, the driving motors rotate the photoconductor drums 5Y, 5M, 5C, and 5K in a counterclockwise direction in accordance with the image forming operation. The scanner units 10Y, 10M, 10C, and 10K emit exposure light beams to the photoconductor drums 5Y, 5M, 5C, and 5K, respectively, to selectively expose the surfaces of the photoconductor drums 5Y, 5M, 5C, and 5K. Thus, electrostatic latent images are formed.

The image forming unit includes four injection charging units 7Y, 7M, 7C, and 7K in the corresponding stations for charging yellow (Y), magenta (M), cyan (C), and black (K) photoconductor drums, respectively. In addition, the injection charging units 7Y, 7M, 7C, and 7K include sleeves 7YS, 7MS, 7CS, and 7KS, respectively. The injection charging units 7Y, 7M, 7C, and 7K provide a primary charging mechanism.

The image forming unit further includes four developing units 8Y, 8M, 8C, and 8K in the corresponding stations so as to develop yellow (Y), magenta (M), cyan (C), and black (K) images, respectively. In addition, the developing units 8Y, 8M, 8C, and 8K include sleeves 8YS, 8MS, 8CS, and 8KS, respectively. The developing units 8Y, 8M, 8C, and 8K are removably mounted on the body of the image forming apparatus.

The intermediate transfer belt 12 is in contact with the photoconductor drums 5Y, 5M, 5C, and 5K. When a color image is formed, the intermediate transfer belt 12 rotates in a clockwise direction in FIG. 15. The intermediate transfer belt 12 is rotatingly driven by the rotations of the photoconductor drums 5Y, 5M, 5C, and 5K so that visible images are transferred onto the intermediate transfer belt 12. In addition, when an image is formed, a transfer roller 9*a*, which is described below, contacts the intermediate transfer belt 12 so as to pinch the transfer medium 2 and convey the transfer medium 2. Thus, a color visible image formed on the intermediate transfer belt 12 is in contact with the transfer medium 2 and is transferred onto the transfer medium 2 at one time.

When the color visible image formed on the intermediate transfer belt 12 is transferred onto the transfer medium 2, the transfer roller 9*a* is in contact with the intermediate transfer belt 12. However, after a print operation is completed, the transfer roller 9*a* is moved away from the intermediate transfer belt 12 to a position 9*b*.

The fixing unit 13 fixes the transferred color visible image while conveying the transfer medium 2. As shown in FIG. 15, the fixing unit 13 includes a fuser roller 14 that applies heat to the transfer medium 2 and a pressure roller 15 that urges the transfer medium 2 against the fuser roller 14. The fuser roller 14 and the pressure roller 15 are hollow inside so as to allow incorporation of a heater 16 and a heater 17, respectively. That is, the transfer medium 2 bearing the color visible image is conveyed by the fuser roller 14 and the pressure roller 15. At the same time, by applying heat and pressure to the transfer medium 2, the toner is fixed on the surface of the transfer medium 2.

A cleaning unit 21 removes residual toner from the photoconductor drums 5Y, 5M, 5C, and 5K and the intermediate transfer belt 12. Residual toner left on the photoconductor drums 5Y, 5M, 5C, and 5K after the visible toner images are transferred to the intermediate transfer belt 12 is stored in a cleaner container (not shown) by the cleaning unit 21. Alternatively, residual toner left on the intermediate transfer belt 12 after the four-color visible image formed on the intermediate transfer belt 12 is transferred to the transfer medium 2 is stored in a cleaner container (not shown) by the cleaning unit 21.

A flapper solenoid 23 switches between a face-up (FU) tray 24 and a face-down (FD) tray 25 having a longer conveying path than the FU tray 24 so that the transfer medium 2 having the fixed visible image is output to the selected tray. After the transfer medium 2 is output onto either one of the FU tray 24 and the FD tray 25, the image forming operation is completed. As used herein, the term "face-up (FU)" refers to an output of the transfer medium 2 with the surface having a formed image facing upward, and the term "face-down (FD)" refers to an output of the transfer medium 2 with the surface having a formed image facing downward.

When the transfer medium 2 is normally conveyed, the printer having such a configuration temporarily stops the conveyance of the transfer medium 2 after a predetermined time period has elapsed from the time that a sensor 19 detects the passage of the leading edge of the transfer medium 2 (see FIG. 18A). Note that the sensor 19 also functions as a sensor for detecting a paper jam. At that time, as shown in FIG. 18B, the transfer medium 2 is curved by a roller 28. Thereafter, the printer starts driving the roller 28 in synchronization with the movement of the image formed on the intermediate transfer belt 12 to resume conveyance of the transfer medium 2.

An exemplary control operation of a transfer medium performed by the engine control unit 201 is described next with reference to FIGS. 19 and 20.

FIG. 19 is a flow chart illustrating a sequence of detecting the size of the transfer medium 2 using the sensor 19 of the engine control unit 201. As used herein, the term "detected size of a transfer medium" refers to the length of a transfer medium in a direction in which the transfer medium is conveyed. The sensor 19 and the engine control unit 201 function as a size detecting unit that detects the size of the transfer medium 2. The size detecting unit is described later.

As shown in FIG. 19, the engine control unit 201 determines the time to resume conveyance of the transfer medium 2 in a state shown in FIG. 18B (step S501). When the time to resume conveyance of the transfer medium 2 is reached, the engine control unit 201 starts a timer count (step S502). The transfer medium 2 is then conveyed. When the sensor 19 detects the passage of the trailing edge of the transfer medium 2 (step S503) (see FIG. 18C), the engine control unit 201 stops the timer count. The engine control unit 201 computes the size of the transfer medium 2 on the basis of a predetermined curved value, a distance between the sensor 19 and the roller 28, and a timer count value (step S504). A variety of computing methods can be employed in accordance with the required precision and efficiency. Since these computing methods are well known to those skilled in the art, description is not provided here. If it is determined at step S505 that the difference between the size of the transfer medium 2 computed at step S504 and a size specified by the controller 202 is within a predetermined range, the engine control unit 201 completes the size detection sequence. However, if the difference is not within the predetermined range, the processing of the engine control unit 201 proceeds to step S506. At step S506, the engine control unit 201 moves the transfer roller 9*a* away from the intermediate transfer belt 12 and sends a message indicating that the size of the transfer medium 2 does not match the specified size to the controller 202. Thus, the controller 202 determines that a print failure occurred. In this case, the transfer medium 2 is output to a paper output tray specified by the controller 202. This operation is described in more detail below with reference to FIG. 20.

In the above-described image forming apparatus having the mechanism of detecting an actual size of the conveyed transfer medium 2 and a plurality of paper output ports, the control of outputting the transfer medium 2 when the specified size does not match the actual size of the transfer medium 2 is described next with reference to FIG. 20.

The engine control unit 201 detects a timing of the conveyed transfer medium 2 passing the sensor 19 and determines the size of the transfer medium 2 using the detection result (step S601). This process is similar to that shown in FIG. 19. If the computed size of the transfer medium 2 matches the size specified by the controller 202, the engine control unit 201 determines that a paper output port specified by the controller 202 is one that can output the transfer medium 2. Accordingly, the engine control unit 201 outputs the transfer medium 2 to the paper output port specified by the controller 202 (steps S602 and S610).

However, if the computed size of the transfer medium 2 does not match the specified size, the engine control unit 201 performs the following control (steps S602 and S603).

The engine control unit 201 determines whether the specified paper output port is the FD tray 25 or the FU tray 24 (step S603). If the FU tray 24 is selected (step S604), the engine control unit 201 switches the flapper solenoid 23 to the FU tray 24 (step S607) so as to output the transfer medium 2 onto the FU tray 24 (step S608).

However, if the FD tray 25 is selected, the engine control unit 201 compares the detected size of the transfer medium 2 with a maximum distance between rollers in a conveying path towards the FD tray 25 (step S604). If the size of the transfer medium 2 is greater than the maximum distance between the rollers, the transfer medium 2 can be output to the FD tray 25. However, if the maximum distance between the rollers is greater than the size of the transfer medium 2, the transfer medium 2 cannot be conveyed and is left in the image forming apparatus. Therefore, it is determined that the transfer medium 2 cannot be output to the FD tray 25. If it is determined that the transfer medium 2 can be output to the FD tray 25, the engine control unit 201 switches the flapper solenoid 23 to the FD tray 25 (step S605) so as to output the transfer medium 2 to the FD tray 25 (step S606). However, if the size of the transfer medium 2 is smaller than the maximum distance between the rollers, and therefore, the transfer medium 2 cannot be delivered to the FD tray 25, the engine control unit 201 switches the flapper solenoid 23 to the FU tray 24 so as to forcibly output the transfer medium 2 to the FU tray 24 (steps S604, S607, and S608).

As noted above, if the specified size of the transfer medium 2 is different from the actually detected size and if the detected size is so small that the transfer medium 2 cannot be output to the FD tray 25, the engine control unit 201 automatically outputs the transfer medium 2 to the FU tray 24. Thus, the transfer medium 2 that would cause a print failure can be output to outside the image forming apparatus without remaining inside the image forming apparatus. Thus, ease of use can be improved.

A control method for the case when a paper output option unit is installed on the image forming apparatus and the specified size is different from the actual size of the transfer medium 2 is described next.

The paper output option unit exchanges information with the engine control unit 201 through the controller 202. Accordingly, a method is described in which the controller 202 determines a paper output port that can output the transfer medium 2 so that print and conveyance operations are smoothly performed.

FIG. 21 is a flow chart illustrating a sequence of the operations performed by the engine control unit 201 including an operation for detecting the size of the transfer medium 2. FIG. 22 is a flow chart illustrating control of outputting the transfer medium 2 performed by the controller 202. FIGS. 23 and 24 are timing diagrams illustrating a relationship between the size of the transfer medium 2 and a switching operation between paper output ports of the paper output option unit. FIG. 25 is a cross-sectional view of the image forming apparatus on which the paper output option unit having a staple function or a booklet maker function is installed. FIG. 26 is a block diagram illustrating a relationship among the engine control unit 201, the controller 202, and a paper output option control unit (neither is shown in FIG. 25).

An exemplary structure of an image forming apparatus on which a paper output option unit 30 is installed is described next with reference to FIG. 25. When the paper output option unit 30 is installed, a printer engine has no paper output ports. Only an FU1 paper output port (FU tray) 24 and an FU2 paper output port 31, which are paper output ports of the paper output option unit 30, are provided. A flapper solenoid 29 in the paper output option unit 30 switches whether the transfer medium 2 is output to the FU1 paper output port 24 or the FU2 paper output port 31. The transfer medium 2 is output from the printer engine and is delivered to the paper output option unit 30. Thereafter, the transfer medium 2 is output to one of the FU1 paper output port 24 and the FU2 paper output port 31 by a paper output option control unit.

As shown in FIG. 26, the engine control unit 201 exchanges information 1001 and 1002 with a paper output option control unit 214 through the controller 202. The paper output option control unit 214 receives a command from the controller 202 so as to control the paper output option unit 30.

As shown in FIG. 21, the engine control unit 201 determines whether the paper output option unit 30 is installed or not (step S701). If the paper output option unit 30 is not installed, the engine control unit 201 performs control in a manner similar to that described in FIG. 20 (step S705). However, if the paper output option unit 30 is installed, the engine control unit 201 detects the size of the transfer medium 2, as illustrated in FIG. 19 (step S702). Then, the engine control unit 201 makes a determination shown at step S602. If the result is "NO", the processing proceeds to step S610. If the detected size does not match the specified size, the engine control unit 201 sends a status message indicating that the specified size does not match the detected size and the detected size itself to the controller 202 (steps S703 and S704).

As shown in FIG. 22, the paper output option control unit 214 sends the size data of a transfer medium that can be output from the FU1 paper output port 24 and the size data of a transfer medium that can be output from the FU2 paper output port 31 to the controller 202 in advance (step S1201). The controller 202 determines whether it has received the status message indicating that the specified size does not match the detected size and the detected size itself from the engine control unit 201. If the controller 202 has received the status message, the processing proceeds to step S1203 (steps S1202 and S1203).

The controller 202 determines whether the size of the transfer medium 2 is one that can be output from a paper output port specified by a host computer. That is, the controller 202 compares the size of the transfer medium 2 detected by the engine control unit 201 with the size of a transfer medium that can be output from the specified paper output port (the size received from the paper output option control unit 214). Thus, the controller 202 determines whether the transfer medium 2 can be output to the specified paper output port (step S1203). If the size of the transfer medium 2 detected by the engine control unit 201 is within the range of the size of a transfer medium that can be output from the specified paper output port, the controller 202 directly outputs the transfer medium 2 to the specified paper output port. That is, the controller 202 submits a paper output port selection command including the size data of the transfer medium 2 (step S1204). Subsequently, if the controller 202 has not received the size data of the transfer medium 2 at step S1202 and receives the size data from the engine control unit 201 during the paper output (step S1205), the controller 202 performs a process similar to that at step S1203. That is, the controller 202 determines whether the transfer medium 2 can be output to the current paper output port (step S1206). If the paper output cannot be performed (step S1207), the controller 202 sends a user a message indicating that the transfer medium 2 is left in the paper output option unit 30 using a graphic user interface (GUI) on a display unit (not shown) (step S1208). If, at step S1203, the size of the transfer medium 2 detected by the engine control unit 201 is not within the range of the size of a transfer medium that can be output from the specified paper output port, the controller 202 performs a process at step S1209. That is, the controller 202 compares the size of the transfer medium 2 detected by the engine control unit 201 with the size of a transfer medium that can be output from another paper output port (the size received from the paper output option control unit 214). Thus, the controller 202 searches for another paper output port (step S1209). If a paper output port from which the transfer medium 2 can be output is found, the controller 202 submits a paper output port switch command including the size data of the transfer medium 2 to the paper output option control unit 214 so that the paper output option control unit 214 can output the transfer medium 2 using that paper output port (step S1210). However, if no paper output ports from which the transfer medium 2 can be output are found, the controller 202 sends the user a message indicating that the paper output cannot be performed and the transfer medium 2 is left in the printer engine (i.e., a jam occurred) using a GUI on a display unit (not shown) (steps S1211 and S1212). The paper output option control unit 214 receives the paper output port selection command at step S1204 or receives the paper output port switch command at step S1210 so as to switch the flapper solenoid 29 to the specified paper output port. Subsequently, the paper output option control unit 214 outputs the transfer medium 2.

FIGS. 23 and 24 are timing diagrams for detecting a transfer medium when the above-described processes illustrated in FIGS. 21 and 22 are performed. FIG. 23 is a timing diagram for the case when the size of the transfer medium 2 is small. In many cases, the process is performed in accordance with this timing diagram. FIG. 23 corresponds to the processes at steps S1201, S1204, S1205, to "END" or the processes at steps S1203, S1209, S1210, to "END" shown in FIG. 22. FIG. 24 is a timing diagram for the case when the size of the transfer medium 2 is very large compared with that shown in FIG. 23. FIG. 24 corresponds to the processes at steps S1204, S1205, S1206, to "END" or the process at step S1207 shown in FIG. 22. As shown in FIG. 24, if the size of a transfer medium specified in the paper output port selection command is an unconveyable size, the paper output option control unit 214 unconditionally determines that a jam has occurred.

Several documents describe techniques related to the above-described known technologies (refer to, for example, Japanese Patent Laid-Open Nos. 2003-26365, 2003-40468, and 2001-88370).

As described in FIG. 24, in a known technology for detecting the size of a transfer medium, when a very long (a large sized) transfer medium is conveyed, a timing at which the engine control unit 201 sends the size of the transfer medium to the paper output option unit 30 may be delayed. In such a case, since the size of the transfer medium is large (very long), the transfer medium may be input to the paper output option unit 30 before the sensor 19 completes the size detecting operation. In this case, if the transfer medium has a size that cannot be conveyed in the paper output option unit 30, the conveyance of the transfer medium must be forcibly stopped in the paper output option unit 30 (i.e., a conveyance failure like a jam occurs). In addition, when a plurality of transfer media are continuously conveyed and these transfer media are delivered to a conveyance unit for duplex printing in the image forming apparatus, the conveying path of the plurality of transfer media is complicated. In such a case, even when the controller 202 or the paper output option control unit 214 receives information indicating that the size of the transfer medium does not match the size of a transfer medium that can be output to a paper output port and the size itself, it may be difficult to determine to which transfer medium in the conveying path the received information corresponds. The above-described known technologies do not address these issues.

SUMMARY OF THE INVENTION

The present invention provides an image forming apparatus for reducing the occurrence of a conveyance failure in a paper handling unit. In addition, the present invention provides an image forming apparatus capable of smoothly and accurately controlling conveyance of a transfer medium in a paper handling unit and facilitating a conveyance process.

According to an embodiment of the present invention, an image forming apparatus to which a paper handling unit is connected thereto is provided. The image forming apparatus includes an image forming unit configured to form an image, a detecting unit configured to detect the size of a sheet in a direction in which the sheet is conveyed to the image forming unit, and an engine control unit configured to output sheet size mismatch information indicating that the size of the sheet does not match a predetermined size to the paper handling unit before a size detecting operation thereof has been completed if the engine control unit determines that the size of the sheet detected by the detecting unit is greater than the predetermined size.

Further features and aspects of the present invention will become apparent from the following description of exemplary embodiments with reference to the attached drawings.

BRIEF DESCRIPTION OF THE DRAWINGS

FIG. 13 is a flow chart of a process performed by an engine control unit according to a third exemplary embodiment of the present invention.

FIG. 14 is a flow chart of a process performed by an engine control unit according to the third exemplary embodiment of the present invention.

DESCRIPTION OF THE EMBODIMENTS

Exemplary embodiments, features and aspects of the present invention are described in detail with reference to the accompanying drawings. The same numbering will be used in describing similar components in the following drawings.

An image forming apparatus and units according to the exemplary embodiments of the present invention are described next with reference to the accompanying drawings. The image forming apparatus according to the exemplary embodiments has a configuration similar to that illustrated in FIGS. 15 to 26. Therefore, only configurations different from those illustrated in FIGS. 15 to 26 are described below. A transfer medium used in the following embodiments is a recording medium on which an image is to be formed. For example, a recording sheet, such as a plain paper sheet, a thick paper sheet, a glossy paper sheet, or an over head transparency (OHT) sheet, is used.

First Exemplary Embodiment

According to a first exemplary embodiment of the present invention, when a transfer-medium size mismatch occurs, information indicating the transfer-medium size mismatch is sent to a controller and a paper output option unit at the earliest moment so that the conveyance control of the transfer medium including switching of a paper output port is optimized.

Figure 25:
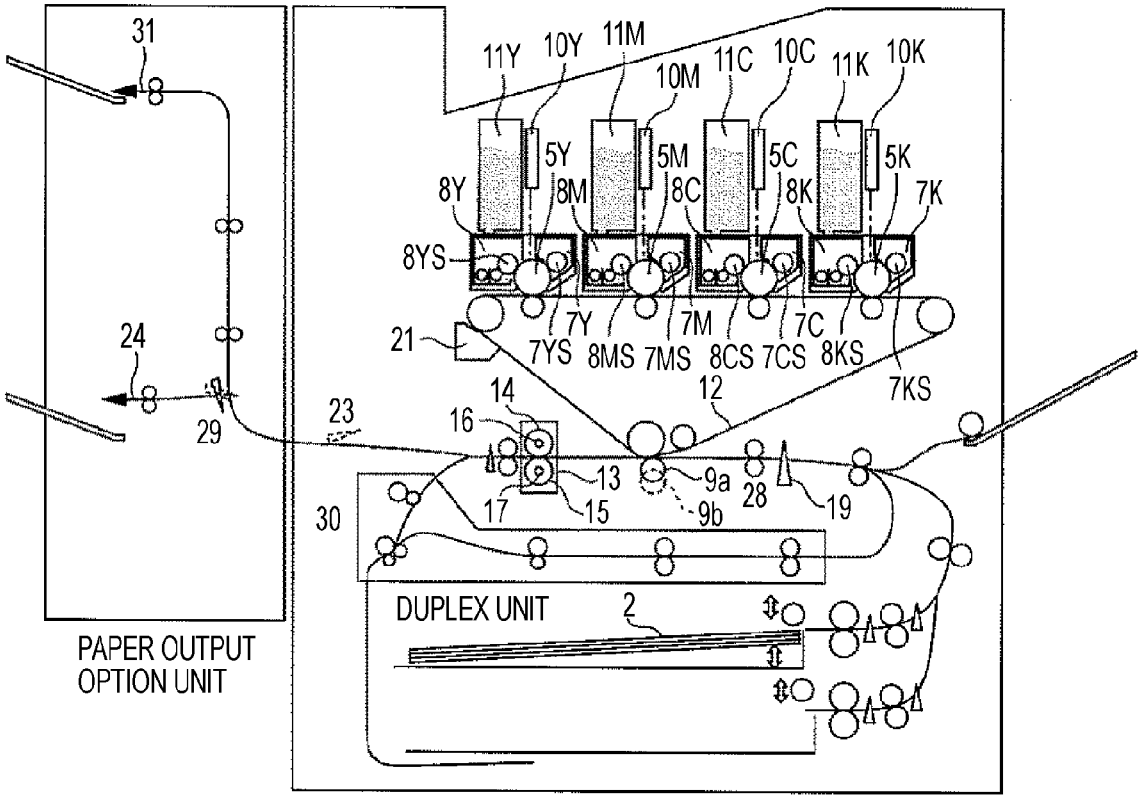
FIG. 25 PRIOR ART
FIG. 25 is a cross-sectional view of a known image forming apparatus in the form of a laser printer on which a paper output option unit is installed.
Figure 26:
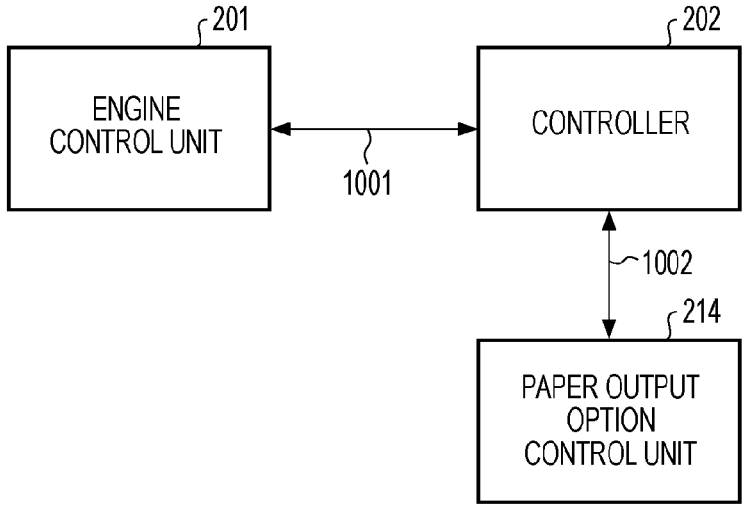
FIG. 26 PRIOR ART
FIG. 26 is a block diagram illustrating a relationship among an engine control unit, a controller, and the paper output option control unit of the known image forming apparatus.

Since the configuration of an image forming apparatus according to the present embodiment is similar to that of the above-described known image forming apparatus shown in FIG. 25, description is not repeated. In addition, similar numbering is used in describing the image forming apparatus according to the present embodiment. Furthermore, a sensor 19 and an engine control unit 201 function as a size detecting unit for detecting the size of a transfer medium.

Figure 1:
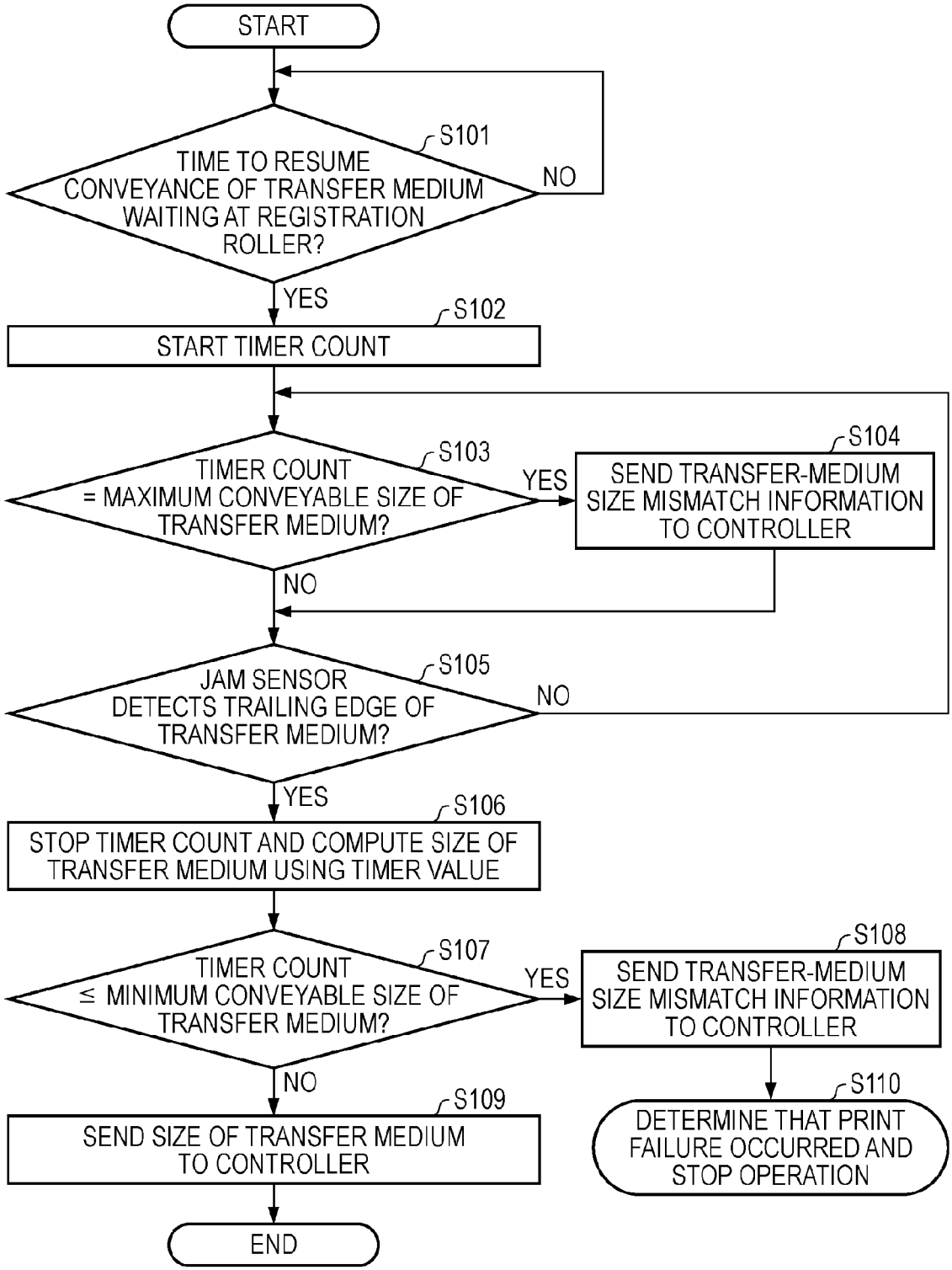
FIG. 1 is a flow chart of an exemplary process performed by an engine control unit according to a first exemplary embodiment of the present invention.

FIG. 1 is a flow chart of a process of detecting the size of a transfer medium performed by an engine control unit 201. This process is performed by a central processing unit (CPU) (not shown) of the engine control unit 201. The CPU reads out a control program from a read only memory (ROM) (not shown) and executes the control program. A difference from the known image forming apparatus is that if the size of a transfer medium exceeds a predetermined value during detection of the size of the transfer medium, the engine control unit 201 sends information indicating the transfer-medium size mismatch (hereinafter referred to as "transfer-medium mismatch information") to the controller 202 before the process of detecting the size of the transfer medium is completed. Subsequently, the engine control unit 201 sends transfer-medium mismatch information at the time of determining the size of the transfer medium to a paper output option control unit 214 even when the size of the transfer medium is less than the predetermined value via the controller 202. Furthermore, the engine control unit 201 sends a message indicating the size of the transfer medium to the paper output option control unit 214 when the trailing edge of the transfer medium has passed the sensor 19. As used herein, the term "predetermined size" refers to the size of a sheet that is conveyable by the paper output option unit 30.

The first exemplary embodiment is described in more detail with reference to FIG. 1. The engine control unit 201 determines the time to resume conveyance of a transfer medium 2 (step S101). When the time to resume the conveyance of a transfer medium 2 is reached, the engine control unit 201 starts a timer count (step S102). The transfer medium 2 is then conveyed. When the sensor 19 detects the passage of the trailing edge of the transfer medium 2 (step S105) (see FIG. 18C), the engine control unit 201 stops the timer count. The engine control unit 201 computes the size of the transfer medium 2 on the basis of a curved value when the transfer medium 2 is temporarily stopped by a roller 28, a distance between the sensor 19 and the roller 28, and a timer count value (step S106). If the sensor 19 cannot detect the trailing edge of the transfer medium 2 even when a time period corresponding to a maximum size of a transfer medium that is conveyable by the paper output option unit 30 has elapsed (step S103), the engine control unit 201 sends transfer-medium mismatch information to the controller 202 (step S104). Subsequently, the engine control unit 201 determines whether the computed size of the transfer medium 2 is significantly less than a minimum size that is conveyable by the paper output option unit 30 (step S107). If a difference between the computed size of the transfer medium 2 and the minimum size that is conveyable by the paper output option unit 30 is within a predetermined range, the engine control unit 201 completes the transfer-medium size detection sequence. However, if the computed size of the transfer medium 2 is less than the minimum size that is conveyable by the paper output option unit 30 (step S107), the processing of the engine control unit 201 proceeds to step S108. The engine control unit 201 sends transfer-medium size mismatch information to the controller 202 (step S108). Thus, the controller 202 determines that a print failure of the transfer medium 2 occurred. The operations of the image forming apparatus and the paper output option unit 30 are stopped (step S110). Thereafter, the engine control unit 201 detects the trailing edge of the transfer medium 2 and sends a message indicating the size of the transfer medium 2 to the controller 202 (step S109).

Figure 2:
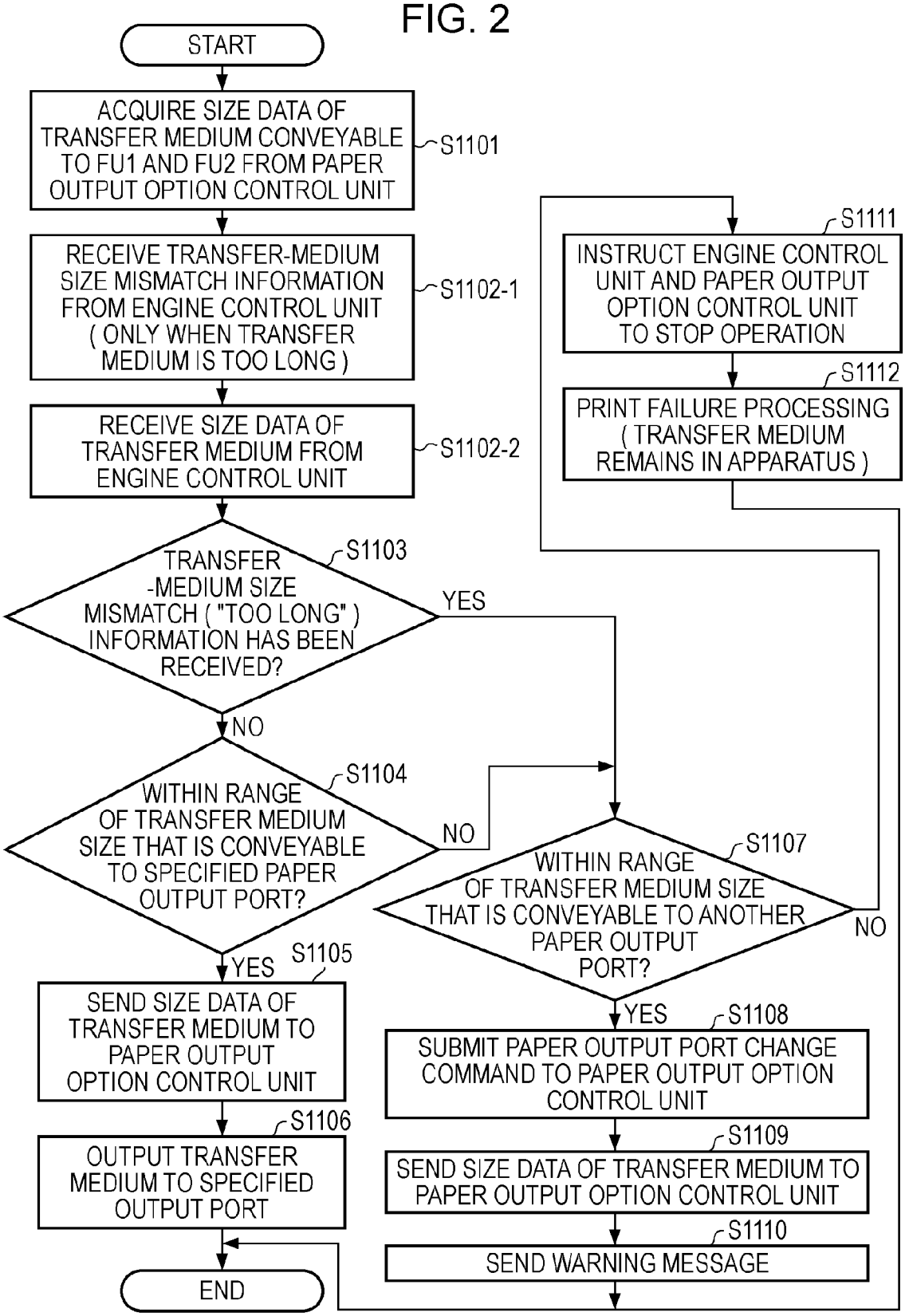
FIG. 2 is a flow chart of an exemplary process performed by a controller according to the first exemplary embodiment of the present invention.

FIG. 2 is a flow chart illustrating a process performed by the controller 202 according to the first exemplary embodiment. To carry out this process, a CPU (not shown) of the controller 202 reads out a control program from a ROM (not shown) and executes the control program.

As shown in FIG. 2, the controller 202 receives, from the paper output option control unit 214, the size data of a transfer medium that is conveyable from an FU1 paper output port 24 and the size data of a transfer medium that is conveyable from an FU2 paper output port 31 (step S1101). The controller 202 sends the received size data of the conveyable transfer media to the engine control unit 201. The engine control unit 201 determines whether a transfer-medium size mismatch occurs on the basis of the received size data. If the engine control unit 201 determines that a transfer-medium size mismatch occurs, the controller 202 receives transfer-medium size mismatch information (step S1102-1). If, however, the engine control unit 201 determines that a transfer-medium size mismatch does not occur, the controller 202 receives no information. Subsequently, the controller 202 receives the size data of the transfer medium 2 from the engine control unit 201 (step S1102-2).

The controller 202 determines whether it has received transfer-medium size mismatch information from the engine control unit 201 (step S1103). If not, the controller 202 determines whether the size of the transfer medium 2 is conveyable from the paper output port specified by a user. Subsequently, the controller 202 compares the size of the transfer medium 2 detected by the engine control unit 201 with the conveyable size of a transfer medium sent from a paper output option control unit 214. In this way, the controller 202 determines whether the transfer medium 2 can be output to the paper output port specified by the user (step S1104). If the size of the transfer medium 2 detected by the engine control unit 201 is within the range of the size of a transfer medium conveyable to the specified paper output port, the controller 202 sends the size data of the transfer medium to the paper output option control unit 214 (step S1105) and outputs the transfer medium 2 to the specified paper output port. In this case, the controller 202 directly outputs the transfer medium 2 to the specified paper output port (step S1106).

However, the controller 202 determines that it has received the transfer-medium size mismatch information, the controller 202 determines whether the size of the transfer medium 2 is conveyable to another paper output port of the paper output option unit 30 (step S1107). If a conveyable paper output port is found, the controller 202 submits a paper output port change command to the paper output option control unit 214 (step S1108). Subsequently, the controller 202 outputs the size data of the transfer medium to the paper output option control unit 214 (step 1109) and sends a warning message to the user (step S1110). This warning message indicates that the transfer medium 2 cannot be output to the specified paper output port and the transfer medium 2 is output to another paper output port. If the size of the transfer medium 2 is such that the transfer medium 2 is unconveyable to any other paper output ports, the controller 202 sends information conveying that fact to the engine control unit 201 and the paper output option unit 30 (step S1111) and stops the print operation. Thereafter, the controller 202 sends a message indicating that a print failure occurred, a paper jam occurred, and a paper sheet is left inside the image forming apparatus to the user (step S1112).

Figure 3:
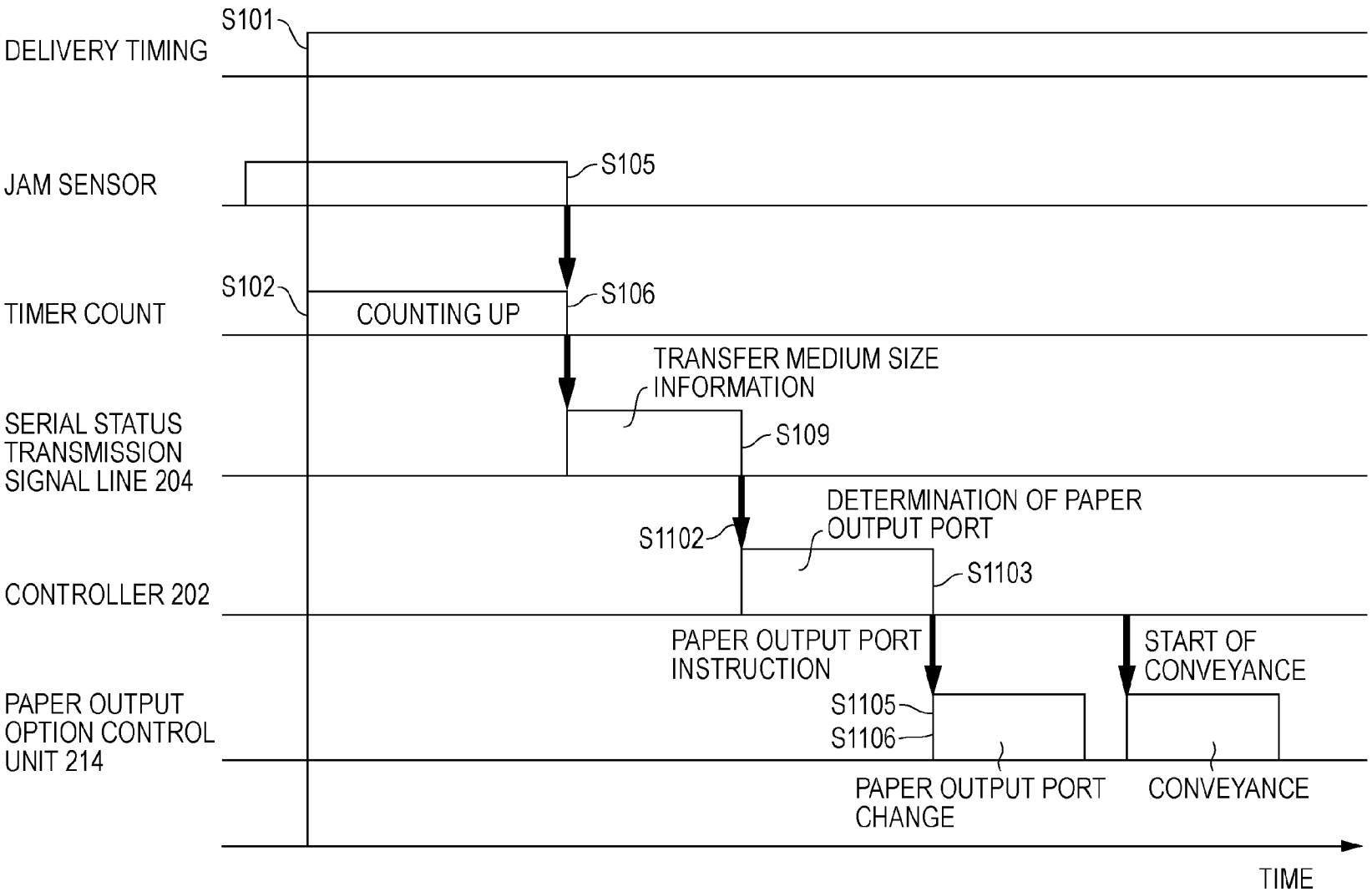
FIG. 3 is a timing diagram in a normal case of conveying a transfer medium according to the first exemplary embodiment of the present invention.
Figure 4:
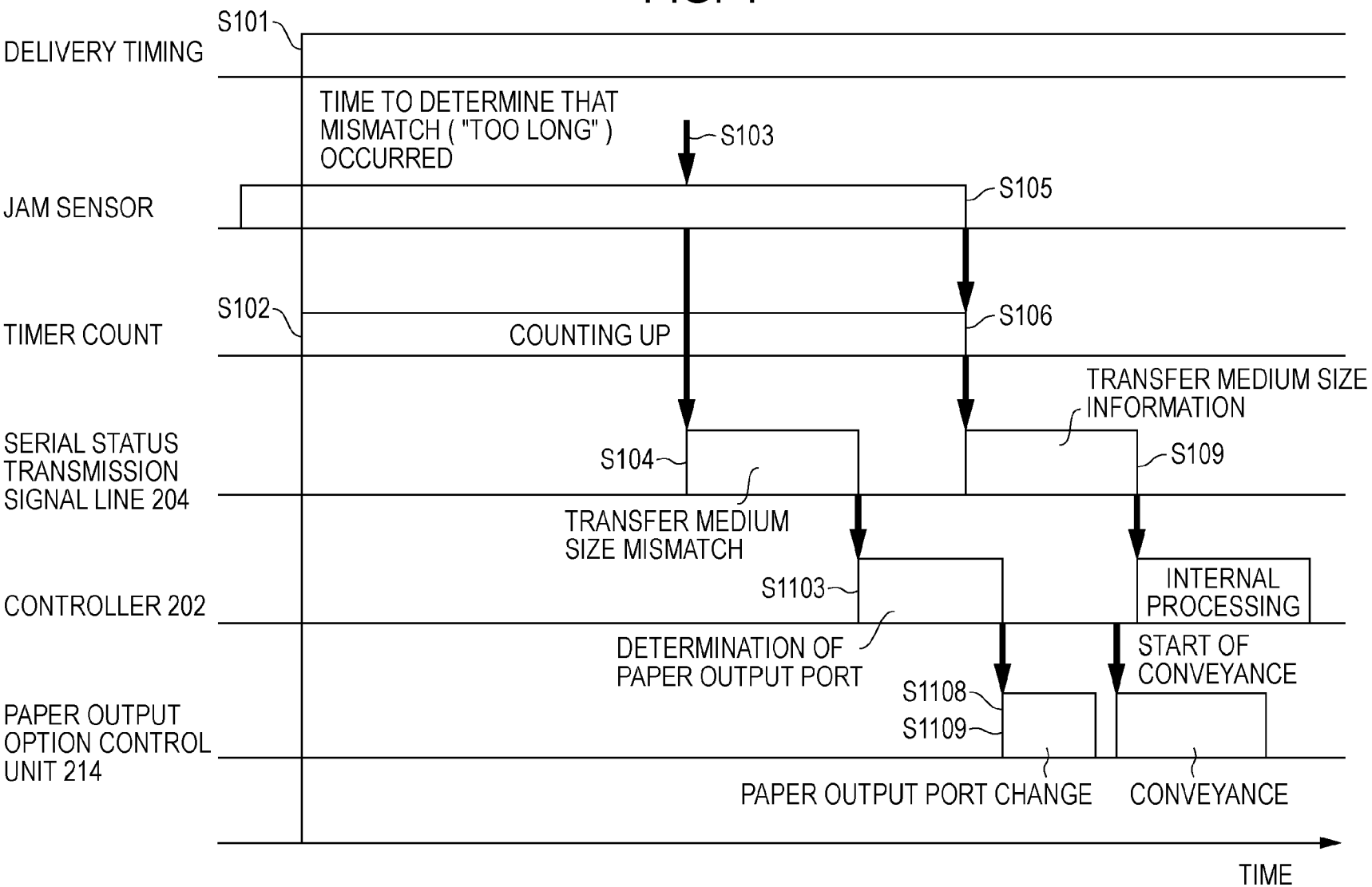
FIG. 4 is a timing diagram for the case when the size of the transfer medium is large according to the first exemplary embodiment of the present invention.

FIGS. 3 and 4 are timing diagram for detecting a transfer medium. FIG. 3 is a timing diagram for the case when the size of the transfer medium is small. In many cases, the process is performed in accordance with this timing diagram. FIG. 4 is a timing diagram for the case when the size of the transfer medium is very large. As used herein, the term "very large size of a transfer medium" refers to a size much larger than the size of a transfer medium that is conveyable by the paper output option unit 30 (e.g., an A3 size). Feature of the present embodiment is the operation of sending the transfer-medium mismatch information. The operation of sending is executed before completion of size detection operation of the transfer medium, that is, the operation of sending is executed before detecting the trailing edge of transfer medium. In addition, the term "size of a transfer medium" refers to the length of a transfer medium in a direction in which the transfer medium is conveyed for forming an image. Furthermore, in the present embodiment, only transfer-medium mismatch information that indicates a transfer medium size mismatch is sent. However, the controller 202 may send the transfer-medium mismatch information together with an identification number (hereinafter also referred to as a "transfer medium number") assigned to each of sheets of a transfer medium in advance. By sending transfer-medium mismatch information together with a transfer medium number, it is clearly determined which transfer medium causes a mismatch. Thus, the controller 202 and the paper output option control unit 214 can perform control more appropriately.

As noted above, in the image forming apparatus to which a paper output option unit can be connected, when the specified size is different from the detected size of a transfer medium, the engine control unit 201 sends transfer-medium size mismatch information to the controller 202 before the size detecting operation performed by the engine control unit 201 is completed. Upon completion of the size detecting operation, the engine control unit 201 sends the detected size data to the controller 202.

In this way, the controller 202 can detect the transfer-medium size mismatch earlier than in known methods. Upon detecting a transfer-medium size mismatch, the controller 202 can select a paper output port capable of outputting the transfer medium, and therefore, the transfer medium can be successfully output. In addition, if the transfer medium cannot be output, the controller 202 can stop the conveyance of the transfer medium at a position at which a user can easily remove the transfer medium (a jam clearance). Thus, ease of use of the image forming apparatus can be improved.

Furthermore, the controller 202 can send the detected size data of a transfer medium to the paper output option unit 30. Thus, the paper output option unit 30 can appropriately set a conveyance speed, a conveyance timing, and a jam determination timing in accordance with the received size data of the transfer medium 2. Consequently, delivery control in the paper output option unit 30 can be facilitated.

Second Exemplary Embodiment

According to a second exemplary embodiment of the present invention, a measured size of a transfer medium is sent to a controller 202 and a paper output option unit 30 together with a transfer medium number assigned to the conveyed transfer medium. The transfer medium number is similar to the one described in Japanese Patent Laid-Open No. 2003-40468. By using the transfer medium number, a correspondence between the size of a transfer medium and the transfer medium is clearly defined. Thus, the processes of the controller 202 and the paper output option control unit 214 can be optimized and simplified.

Since the configuration of an image forming apparatus according to the second exemplary embodiment is similar to that of the above-described known image forming apparatus shown in FIG. 25, description is not repeated. In addition, similar numbering is used in describing the image forming apparatus according to the present embodiment. Furthermore, a sensor 19 and an engine control unit 201 function as a size detecting unit for detecting the size of a transfer medium.

A transfer medium number used in a known image forming apparatus is described first. Subsequently, the present embodiment is described in detail.

Figure 5:
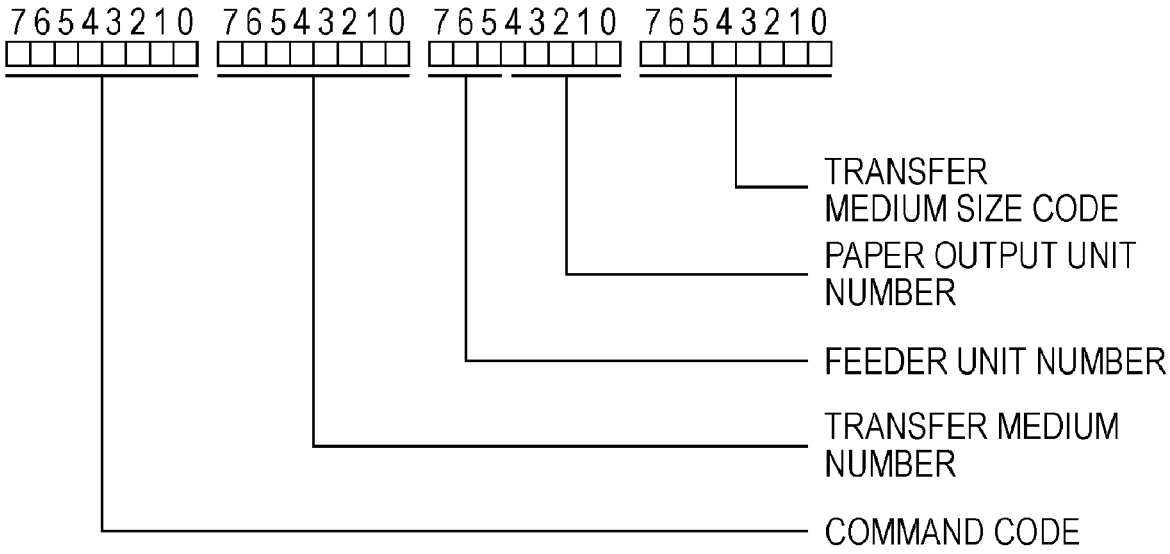
FIG. 5 illustrates an exemplary data structure of a command sent from a controller when feeding of the transfer medium is started according to a second exemplary embodiment of the present invention.

FIG. 5 illustrates an exemplary data structure of a four-byte command that is sent from the controller 202 to the engine control unit 201 and the paper output option control unit 214. This command is used for setting transfer medium information.

As shown in FIG. 5, the first byte represents a command code. This command code indicates setting of transfer medium information. The second byte represents a transfer medium number. The controller 202 can set any number in this byte field. However, the maximum number of the transfer medium number is determined to be 255. If a transfer medium number greater than the maximum number is needed, the transfer medium number assigned to the previous transfer medium is re-assigned to a new transfer medium when the previous transfer medium is output and its transfer medium number is released in a sequential manner.

The most significant three bits of the third byte represent a feeder unit number. A feeder unit number is assigned to each of feeder units by the controller 202. The feeder unit number depends on the number of feeder units connected to the image forming apparatus. In the present embodiment, a number between 1 and 7 can be used as the feeder unit number. The least significant five bits of the third byte represent a paper output unit number. A paper output unit number is assigned to each of paper output units by the controller 202. The paper output unit number depends on the number of paper output units connected to the image forming apparatus. In the present embodiment, a number between 1 and 63 can be used as the feeder unit number.

The fourth byte represents a code corresponding to the size of a transfer medium. Information about the size of a transfer medium received from a host computer (not shown) is converted to a code corresponding to information used for the image forming apparatus.

The controller 202 generates paper feed information and paper output information shown in FIG. 5 from print control information received from the host computer. Subsequently, the controller 202 sends the generated information to the engine control unit 201 and the paper output option control unit 214 together with the feeder unit number, the paper output unit number, and the transfer medium number. According to the present embodiment, upon detecting the size of a transfer medium, the engine control unit 201 sends the transfer medium number and information about the size of the transfer medium to the controller 202 at the same time. The controller 202 sends the information about the size of the transfer medium received from the engine control unit 201 to the paper output option control unit 214.

Figure 6:
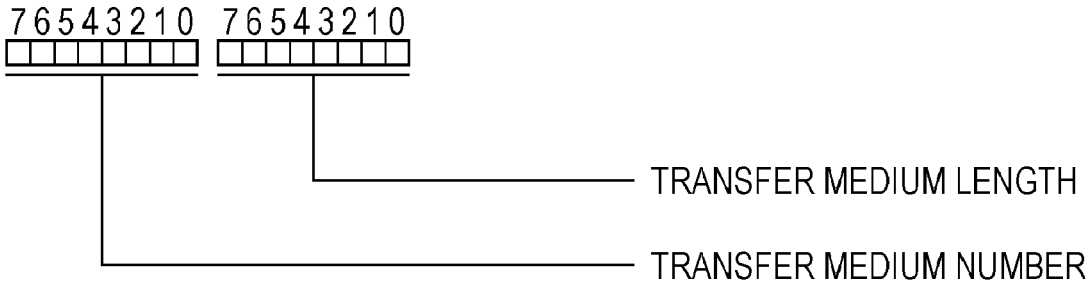
FIG. 6 illustrates an exemplary data structure of status information sent from an engine control unit when the engine control unit detects the size of the transfer medium according to the second exemplary embodiment of the present invention.

FIG. 6 illustrates an exemplary data structure of two-byte status information about the size of a transfer medium sent from the engine control unit 201 to the controller 202. This status information is sent in response to a command requesting the status information about the size of a transfer medium and sent from the controller 202.

Figure 9:
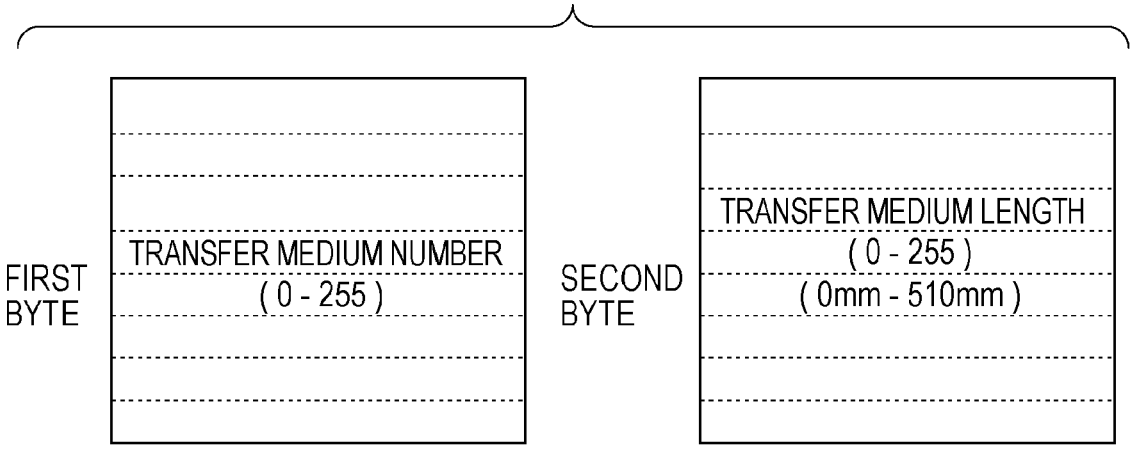
FIG. 9 illustrates the detailed data structure of the status information sent from the engine control unit when the engine control unit detects the size of a transfer medium according to the second exemplary embodiment of the present invention.

FIG. 9 illustrates the detailed structure of the status information about the size of a transfer medium. The first byte represents the transfer medium number. A transfer medium number received from the controller 202 is set in this field when a transfer medium 2 is fed. The second byte represents a detected size of the transfer medium 2. One binary number in the second byte corresponds to 2 mm.

Figure 7:
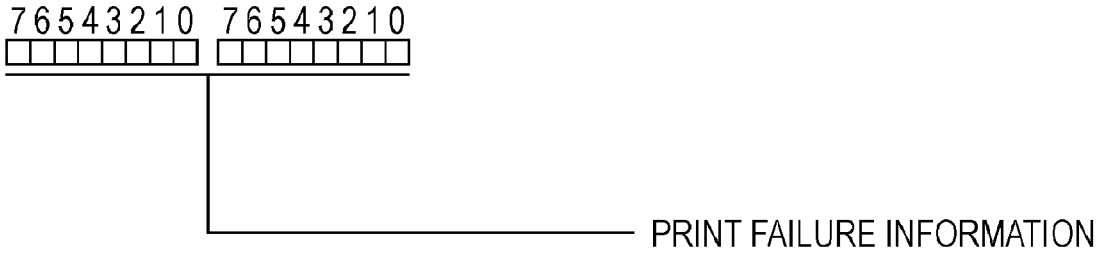
FIG. 7 illustrates an exemplary data structure of status information sent from the engine control unit when a transfer-medium size mismatch occurs according to the second exemplary embodiment of the present invention.
Figure 10:
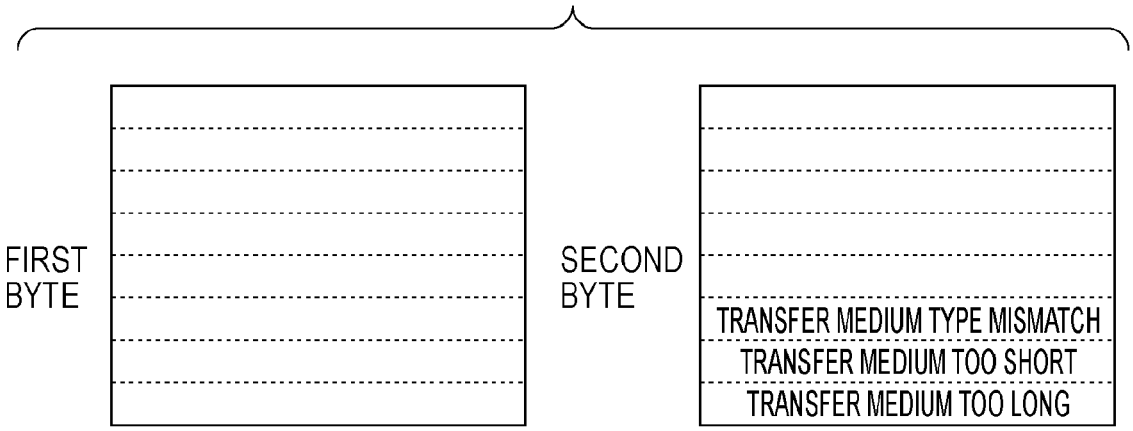
FIG. 10 illustrates the detailed data structure of status information sent from the engine control unit when a transfer-medium size mismatch occurs according to the second exemplary embodiment of the present invention.

FIG. 7 illustrates the data structure of two-byte information indicating print failure sent from the engine control unit 201 to the controller 202. This status information is sent to the controller 202 in response to a command requesting the status information about print failure and sent from the controller 202. FIG. 10 illustrates the details of the status information indicating a print failure. The second byte includes information about the transfer medium detected by the engine control unit 201 representing the transfer-medium type mismatch and the transfer-medium size mismatch information (i.e., information indicating that the transfer medium 2 is too long or too short).

Figure 8:
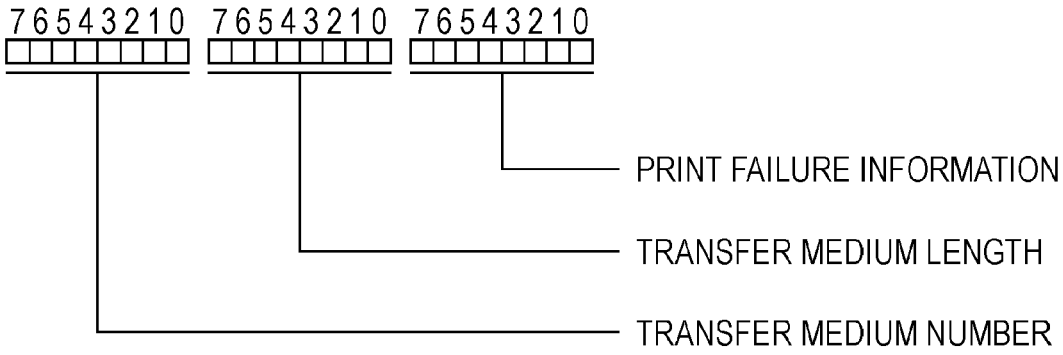
FIG. 8 illustrates an exemplary data structure of status information sent from the engine control unit when a transfer-medium size mismatch occurs according to the second exemplary embodiment of the present invention.

As shown in FIG. 8, information indicating the occurrence of print failure may be sent together with the size of a transfer medium and the transfer medium number at one time.

Figure 11:
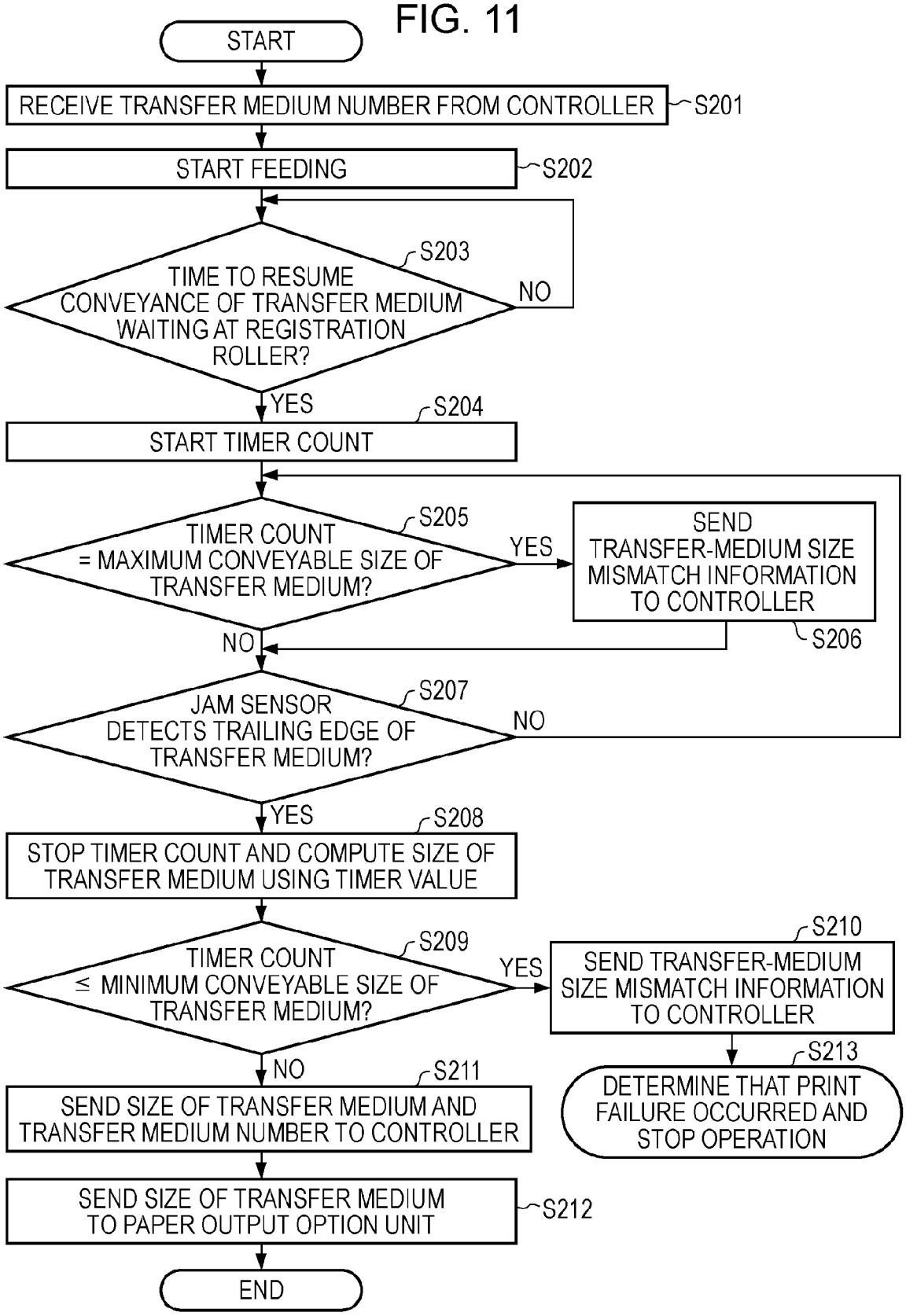
FIG. 11 is a flow chart of a process performed by the engine control unit according to the second exemplary embodiment of the present invention.

FIG. 11 is a flow chart of a process performed by the engine control unit 201 according to the present embodiment. This process is performed by a central processing unit (CPU) (not shown) of the engine control unit 201 reading out a control program from a ROM (not shown).

The process is described in detail below with reference to FIG. 11. When the transfer medium 2 is fed, the engine control unit 201 receives a transfer medium number corresponding to the transfer medium 2 from the controller 202 (step S201) and starts feeding the transfer medium 2 (step S202). Subsequently, the engine control unit 201 determines the time to resume conveyance of the transfer medium 2 (step S203). When the time to resume the conveyance of a transfer medium 2 is reached, the engine control unit 201 starts a timer count (step S204). The transfer medium 2 is then conveyed. When the sensor 19 detects the passage of the trailing edge of the transfer medium 2 (step S207) (see FIG. 18C), the engine control unit 201 stops the timer count (step S208). The engine control unit 201 computes the size of the conveyed transfer medium 2 on the basis of a curved value when the transfer medium 2 is temporarily stopped by a roller 28, a distance between the sensor 19 and the roller 28, and a timer count value (step S208). If the sensor 19 cannot detect the trailing edge of the transfer medium 2 even when a time corresponding to a maximum size of a transfer medium that is conveyable by the paper output option unit 30 has elapsed (step S205), the engine control unit 201 sends transfer-medium mismatch information to the controller 202 (step S206). Subsequently, the engine control unit 201 determines whether the computed size of the transfer medium 2 is significantly less than a minimum size of a transfer medium that is conveyable by the paper output option unit 30 (step S209). If a difference between the computed size of the transfer medium 2 and the minimum size of a transfer medium that is conveyable by the paper output option unit 30 is within a predetermined range, the engine control unit 201 completes the transfer-medium size detection sequence. However, if the computed size of the transfer medium 2 is significantly less than the minimum size of a transfer medium that is conveyable by the paper output option unit 30, the processing of the engine control unit 201 proceeds to step S210. The engine control unit 201 sends transfer-medium size mismatch information to the controller 202 (step S209). At that time, the controller 202 determines that a print failure of the transfer medium 2 occurred. The operations of the image forming apparatus and the paper output option unit 30 are stopped (step S213). Thereafter, the engine control unit 201 sends the size of the transfer medium 2 and the transfer medium number to the controller 202 (step S211). The controller 202 sends the size of the transfer medium 2 and the transfer medium number to the paper output option unit 30 (step S212).

In this way, the paper output option unit 30 can appropriately set a conveyance speed, a conveyance timing, and a jam determination timing in accordance with the received size data of the transfer medium 2 and the transfer medium number. That is, since the paper output option unit 30 can associate the conveyed transfer medium 2 with the size information about the transfer medium 2, the paper output option unit 30 can set a jam determination timing for the transfer medium 2 in accordance with a conveyance speed, a conveyance timing, and the size of the transfer medium 2.

Figure 12:
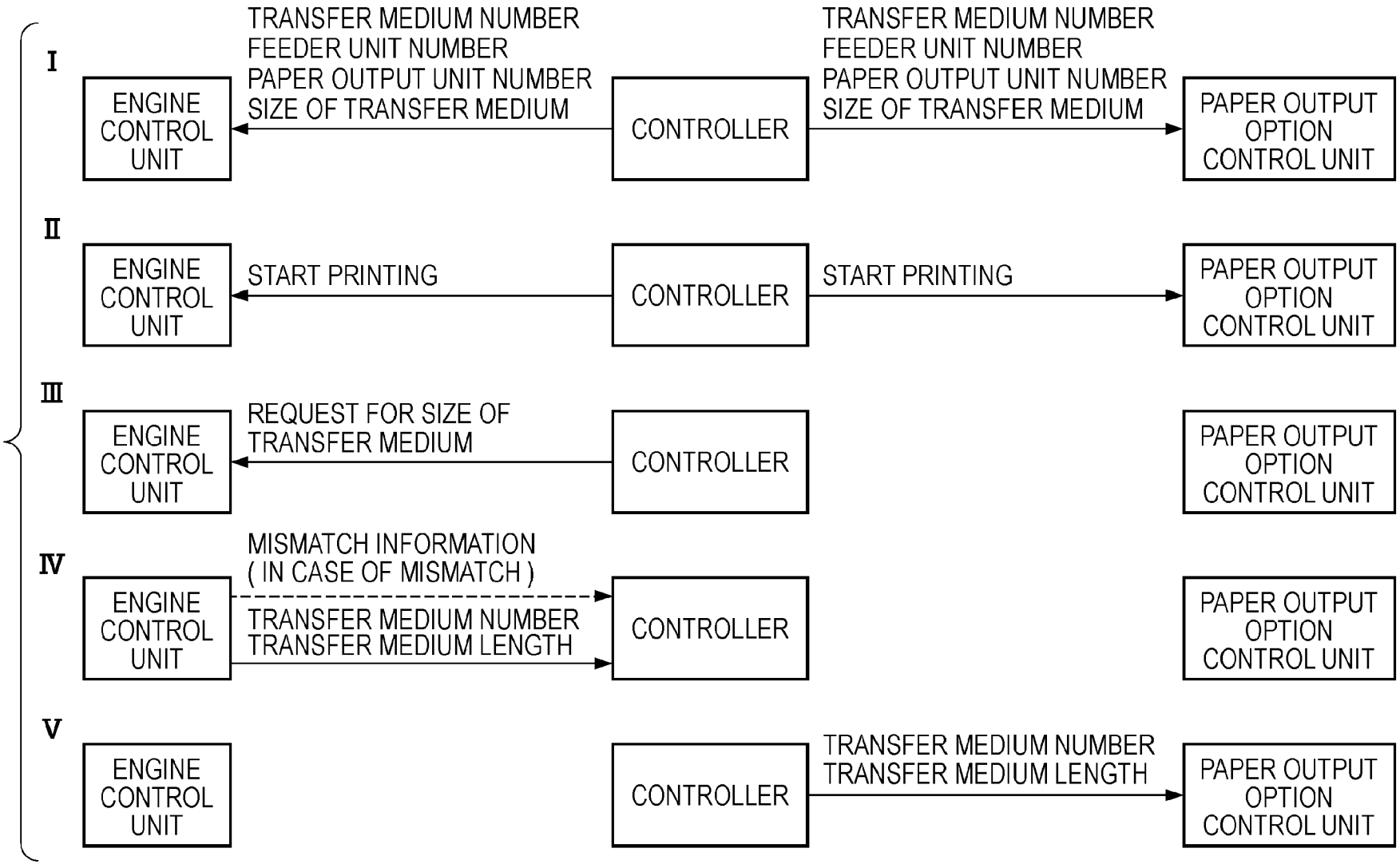
FIG. 12 is a process flow diagram according to the second exemplary embodiment of the present invention.
Figure 15:
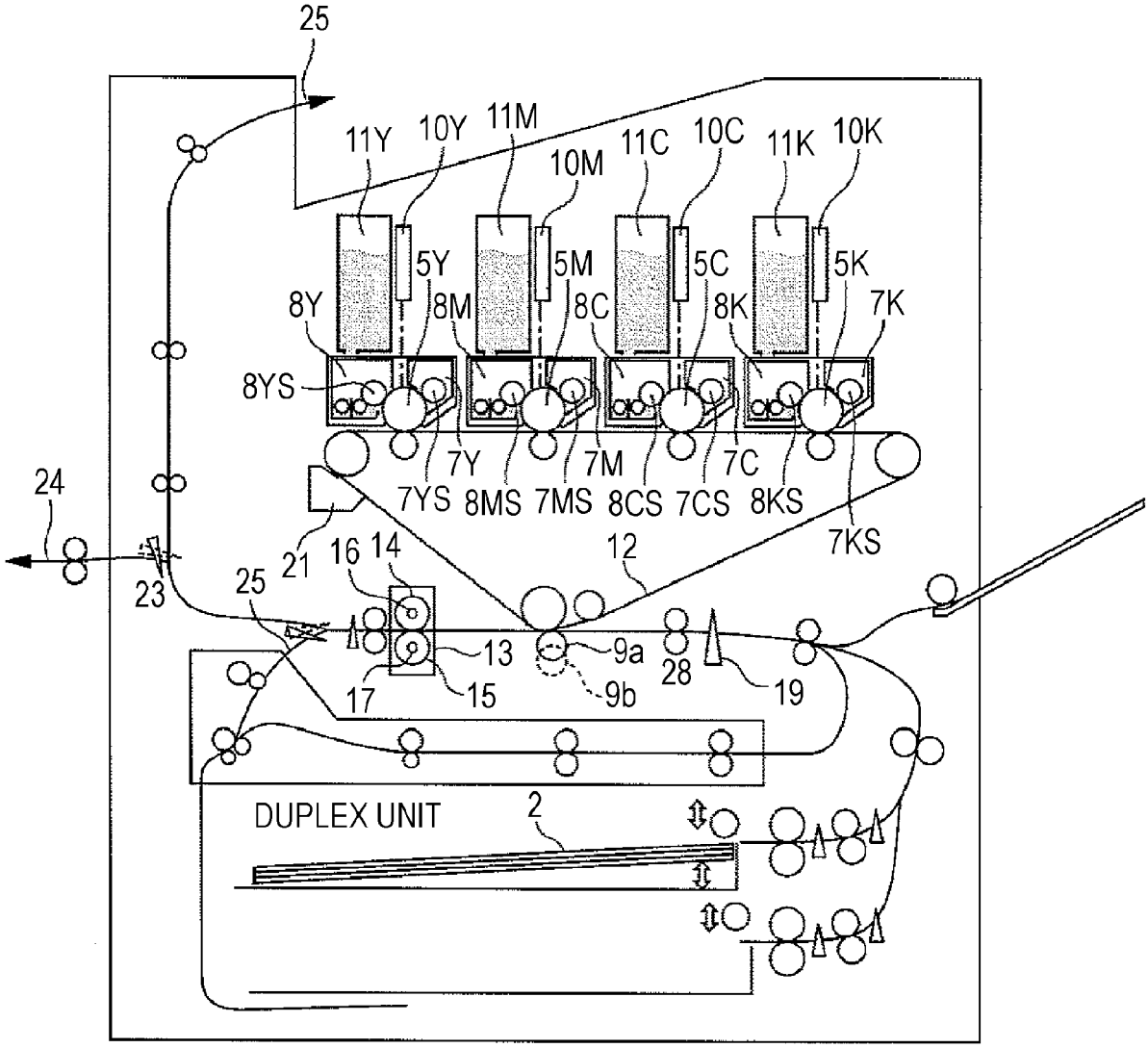
PRIOR ART FIG. 15
FIG. 15 is a cross-sectional view of an exemplary structure of an existing image forming apparatus in the form of a laser printer.
Figure 16:
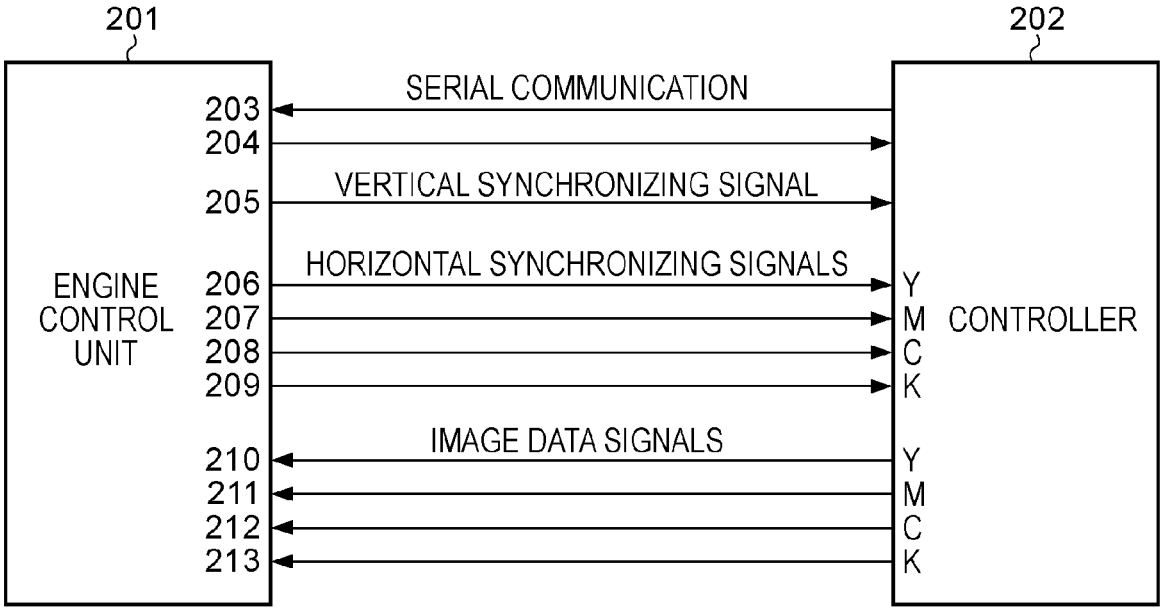
PRIOR ART FIG. 16
FIG. 16 illustrates signals exchanged between a known engine control unit and a controller.
Figure 17:
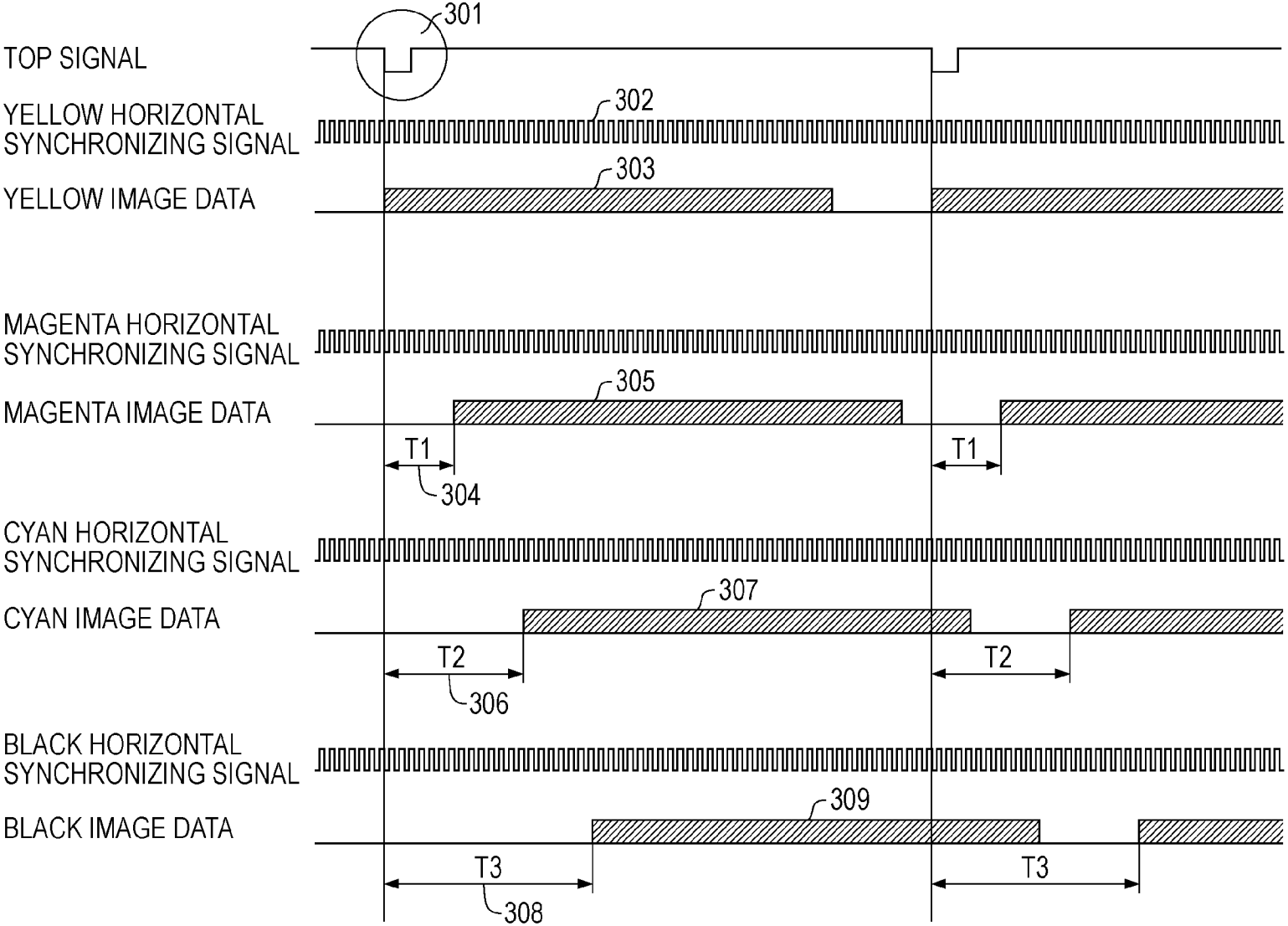
FIG. 17 PRIOR ART
FIG. 17 is a timing diagram illustrating signals exchanged between the known engine control unit and the controller for synchronizing images.
Figure 18A:
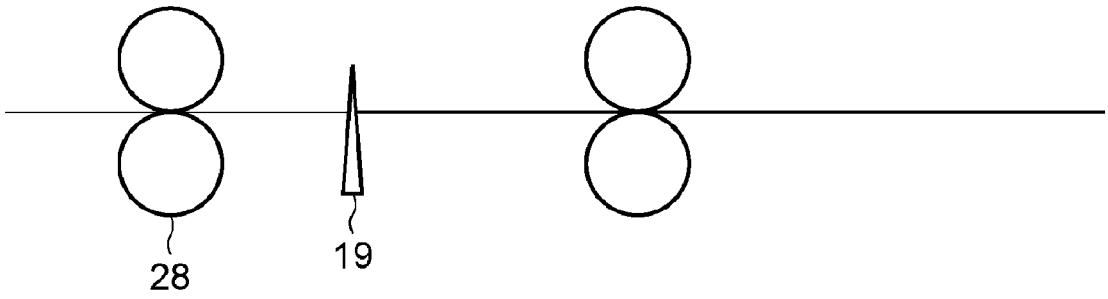
FIG. 18A PRIOR ART
FIGS. 18A-C illustrate the operation of a registration sensor.
Figure 18B:
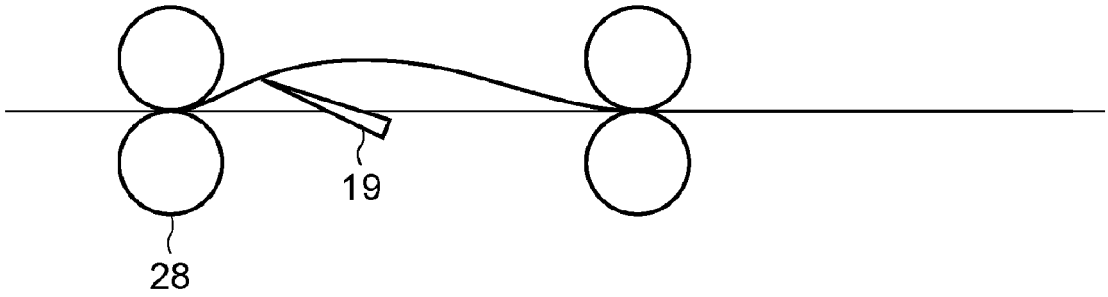
FIG. 18B PRIOR ART
Figure 18C:
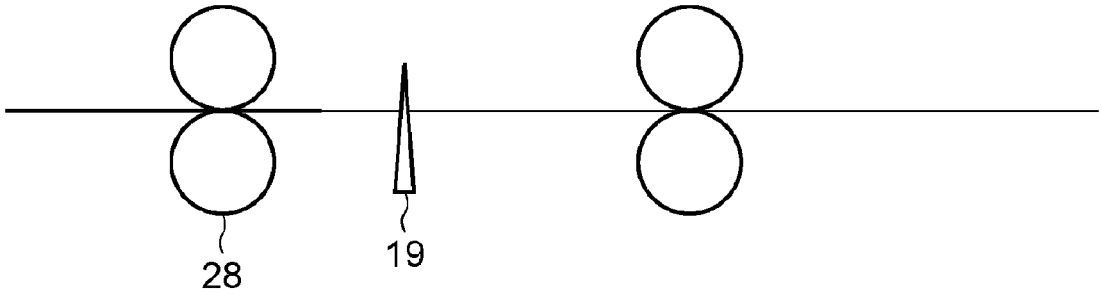
FIG. 18C PRIOR ART
Figure 19:
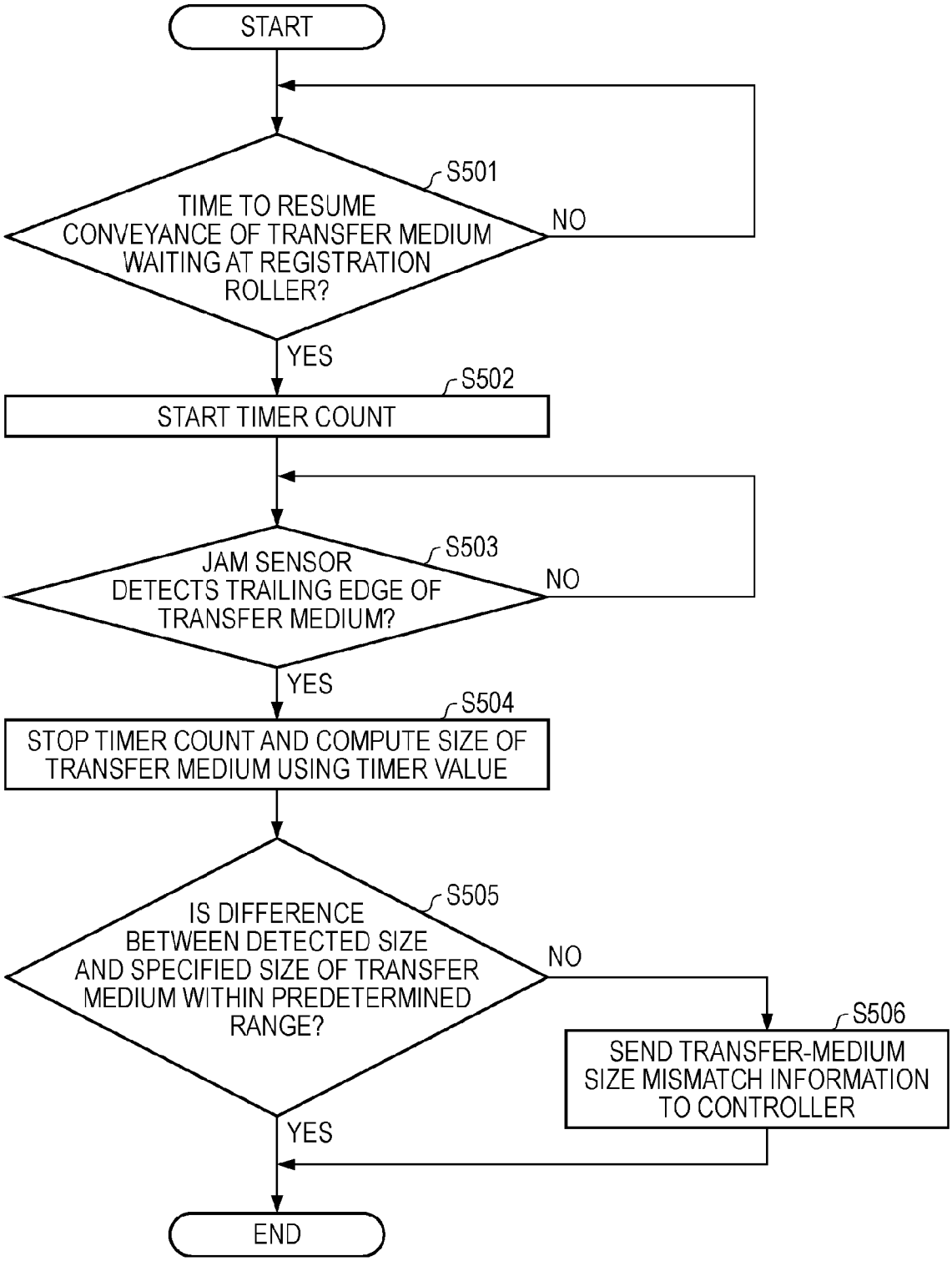
FIG. 19 PRIOR ART
FIG. 19 illustrates a process performed by a known engine control unit.
Figure 20:
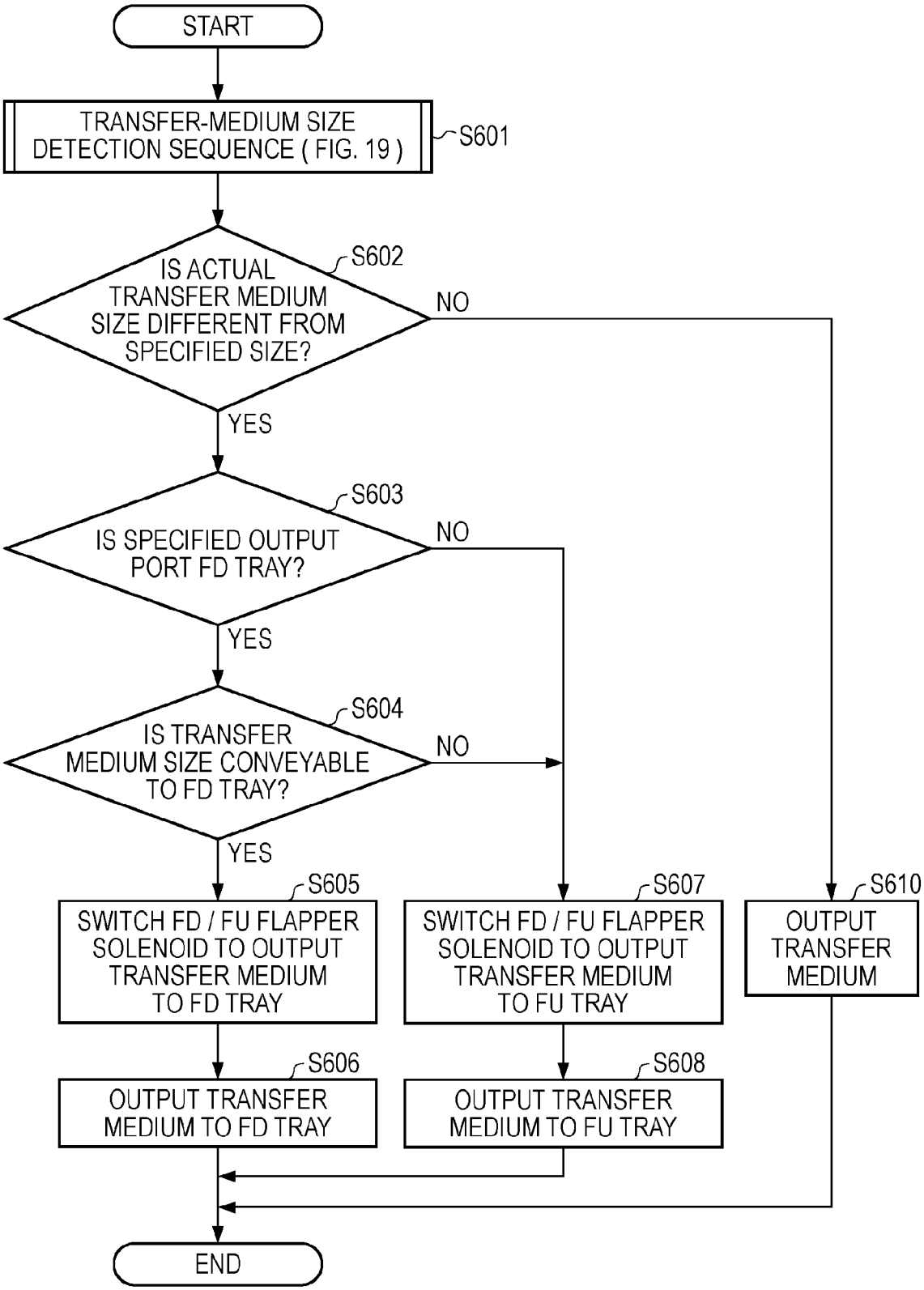
FIG. 20 PRIOR ART
FIG. 20 illustrates a process performed by a known engine control unit.
Figure 21:
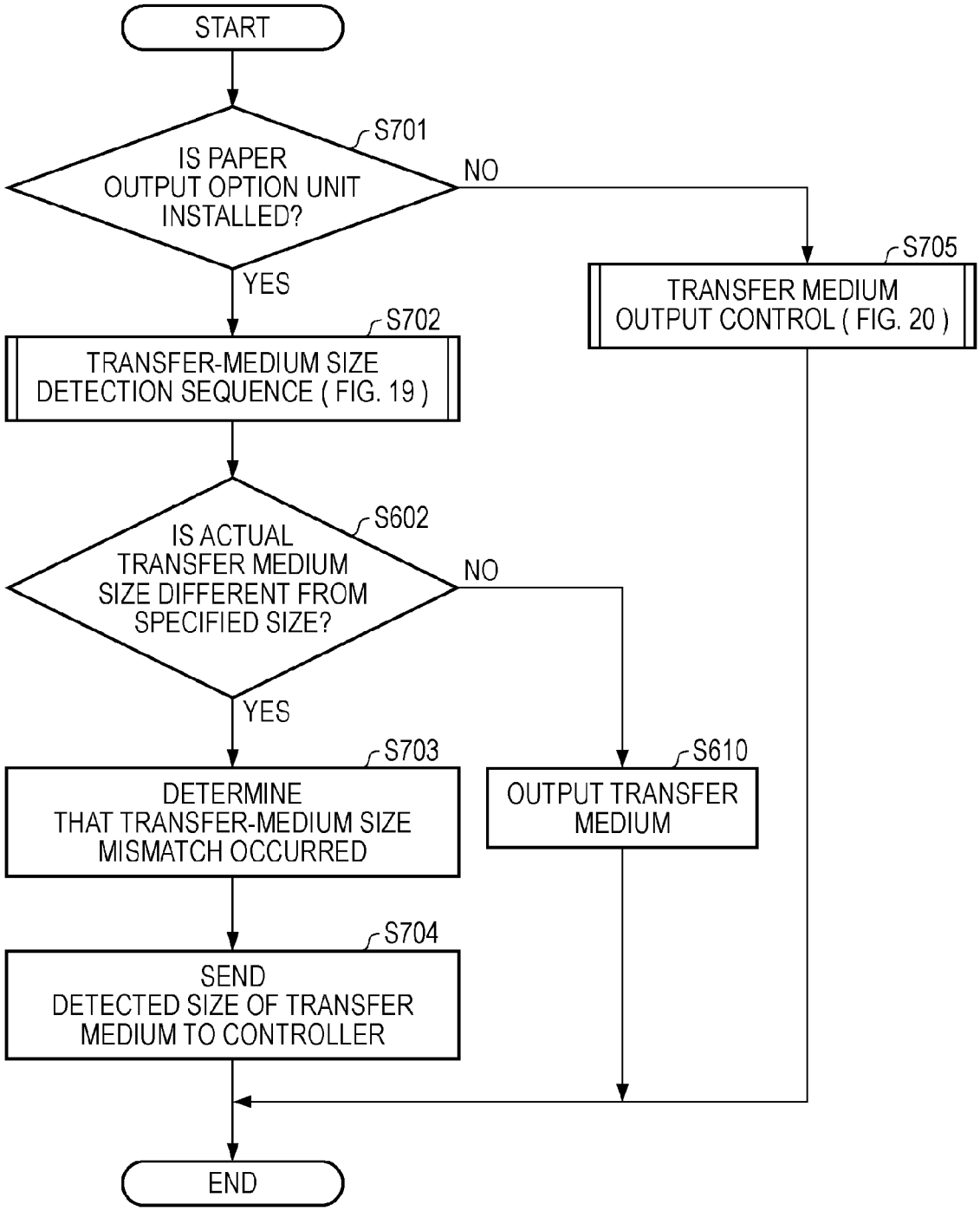
FIG. 21 PRIOR ART
FIG. 21 illustrates a process performed by a known engine control unit.
Figure 22:
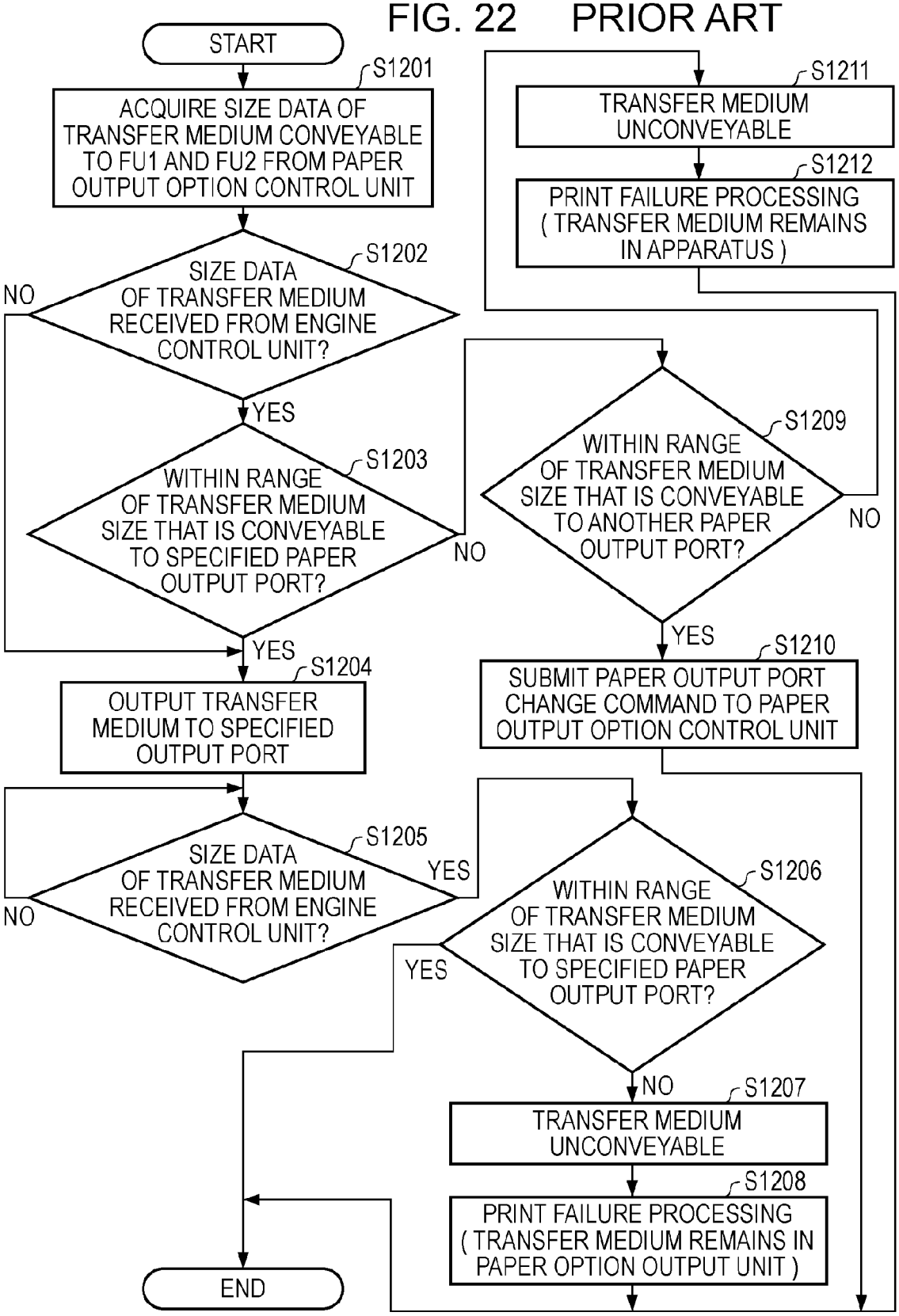
FIG. 22 PRIOR ART
FIG. 22 illustrates a process performed by a known controller.
Figure 23:
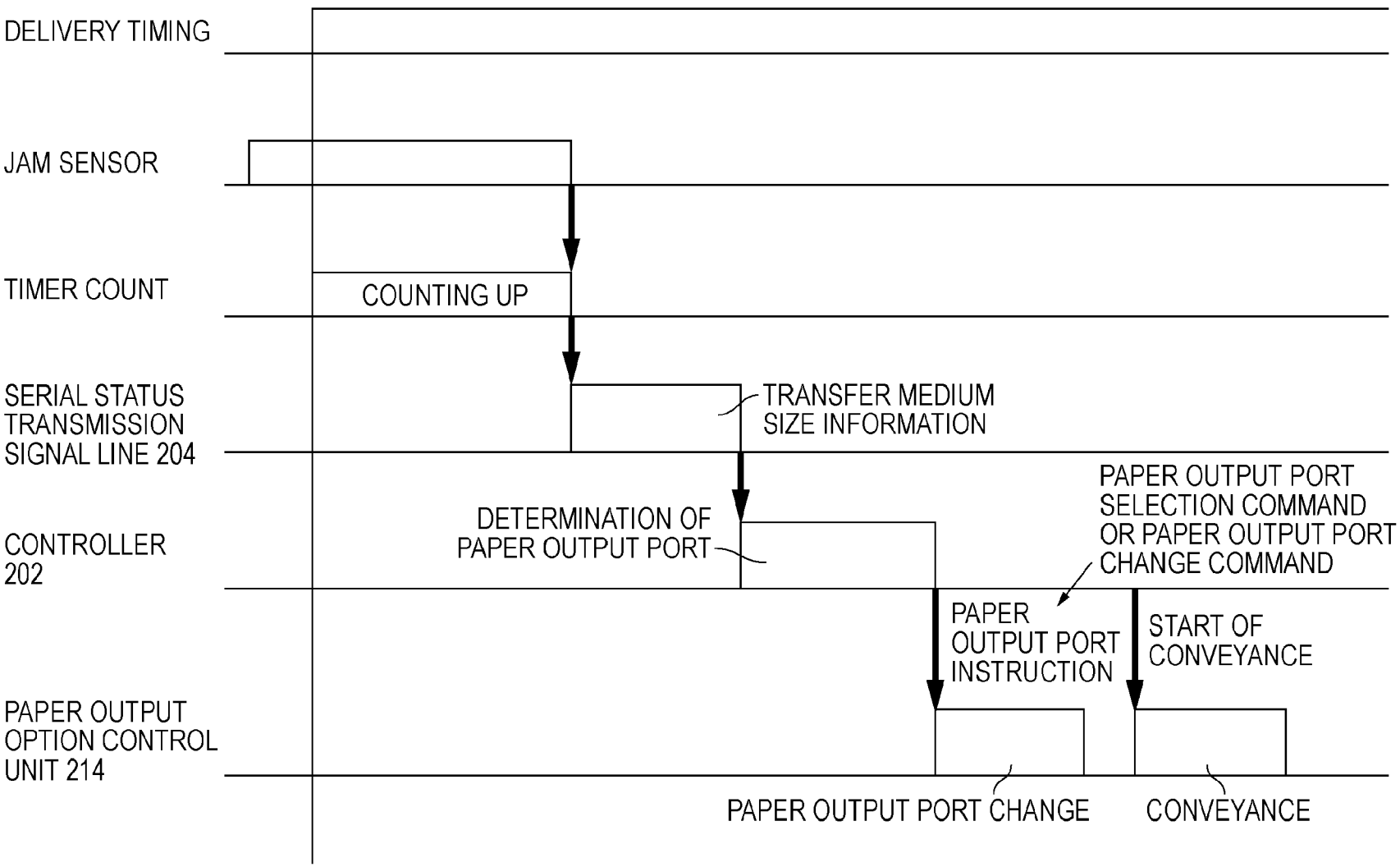
FIG. 23 PRIOR ART
FIG. 23 is a timing diagram for the case of a known normal conveying operation.
Figure 24:
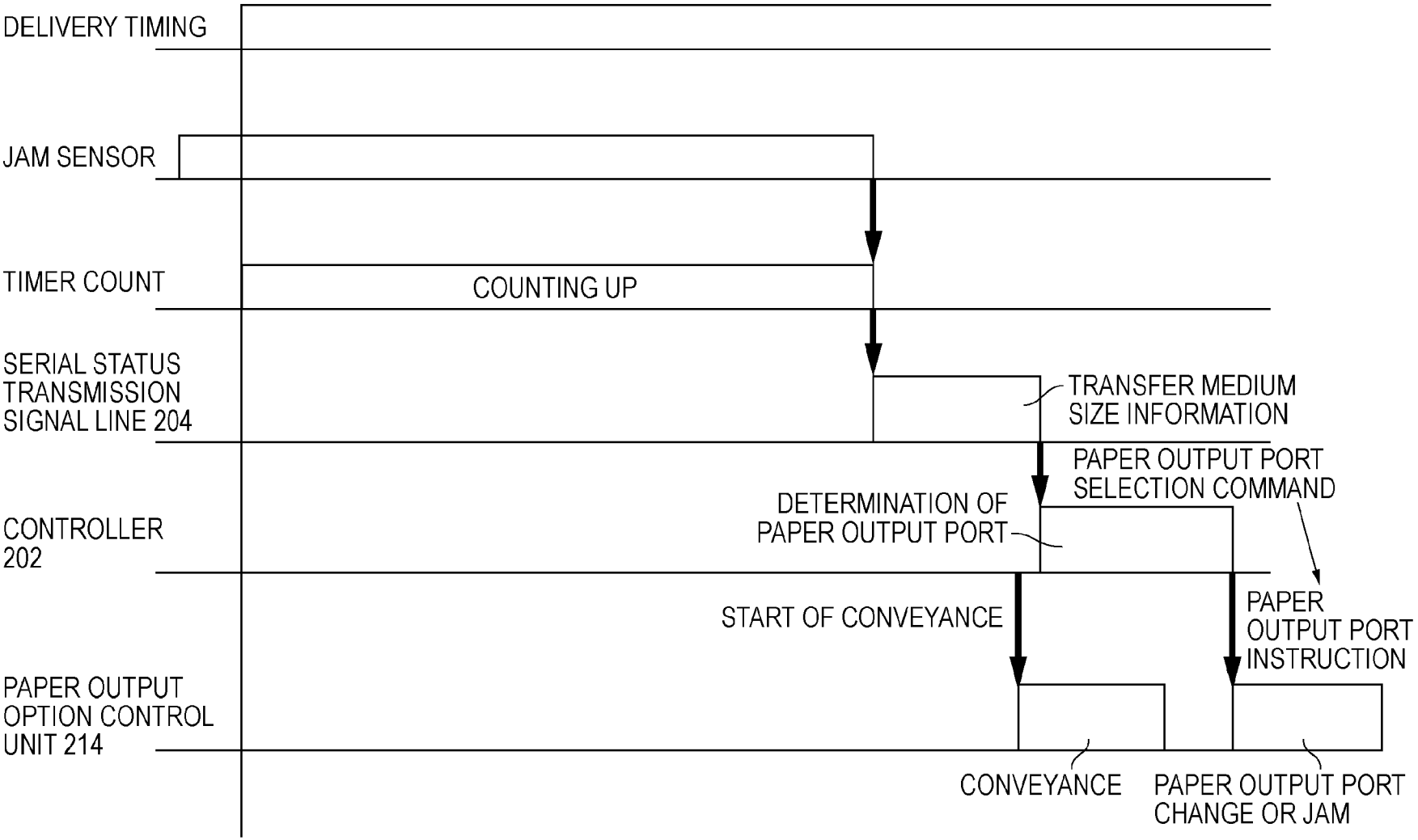
FIG. 24 PRIOR ART
FIG. 24 is a timing diagram for the known case of conveyance of a long transfer medium.

FIG. 12 is a process flow diagram according to the present embodiment. At step I, the controller 202 sends the transfer medium number, the feeder unit number, and the paper output unit number to the engine control unit 201 and the paper output option control unit 214. At step II, the controller 202 sends a print start instruction to the engine control unit 201 and the paper output option control unit 214. At step III, the controller 202 inquires about the size of the transfer medium 2 to the engine control unit 201. The engine control unit 201 detects the size of the transfer medium 2 to determine whether the detected size matches the size (length) of the transfer medium 2 informed by the controller 202. At step IV, if the detected size does not match the size of the transfer medium 2 informed by the controller 202, the engine control unit 201 sends transfer-medium mismatch information to the controller 202. Subsequently, the engine control unit 201 sends the transfer medium number and the size (length) of the transfer medium 2 to the controller 202. Finally, at step V, the controller 202 sends the transfer medium number and the size (length) of the transfer medium 2 to the paper output option control unit 214.

In the present embodiment, the term "size (length) of a transfer medium" refers to the length of a transfer medium in a direction in which the transfer medium is conveyed for forming an image.

Third Exemplary Embodiment

According to a third exemplary embodiment of the present invention, a measured size of a transfer medium is sent to a controller 202 and a paper output option unit 30 together with a transfer medium number only when the transfer medium is output to a paper output option unit 30. Thus, the internal process of a paper output option control unit 214 can be optimized and simplified.

Since the configuration of an image forming apparatus according to the third exemplary embodiment is similar to that of the above-described known image forming apparatus shown in FIG. 25, description is not repeated. In addition, similar numbering is used in describing the image forming apparatus according to the present embodiment. Furthermore, as in the known image forming apparatus, a sensor 19 and an engine control unit 201 function as a size detecting unit for detecting the size of a transfer medium.

FIG. 13 is a flow chart of an example process performed by the engine control unit 201 according to the present embodiment. To carry out this process, a CPU (not shown) of the engine control unit 201 reads out a control program from a ROM (not shown) and executes the control program.

The process is described in detail next with reference to FIG. 13. When the transfer medium 2 is fed, the engine control unit 201 receives a transfer medium number corresponding to the transfer medium 2 from the controller 202 (step S301) and starts feeding the transfer medium 2 (step S302). Subsequently, the engine control unit 201 determines the time to resume conveyance of the transfer medium 2 (step S303). When the time to resume the conveyance of a transfer medium 2 is reached, the engine control unit 201 determines whether the paper output port for the transfer medium 2 is a duplex printing port (step S304). If the paper output port for the transfer medium 2 is a duplex printing port, the engine control unit 201 does not detect the size of the transfer medium 2 and completes the processing. In the case of duplex printing, the size of the transfer medium 2 has already been detected before an image is formed on a first surface of the transfer medium 2. Accordingly, a size detecting operation is not needed. When outputting the transfer medium 2 to the paper output option unit 30, the engine control unit 201 starts a timer count (step S305). The transfer medium 2 is then conveyed. When the sensor 19 detects the passage of the trailing edge of the transfer medium 2 (step S308) (see FIG. 18C), the engine control unit 201 stops the timer count (step S309). Subsequently, the engine control unit 201 computes the size of the conveyed transfer medium 2 on the basis of a curved value when the transfer medium 2 is temporarily stopped by a roller 28, a distance between the sensor 19 and the roller 28, and a timer count value (step S309). If the sensor 19 cannot detect the trailing edge of the transfer medium 2 even when a time period corresponding to a maximum size of a transfer medium that is conveyable by the paper output option unit 30 has elapsed (step S306), the engine control unit 201 sends transfer-medium mismatch information to the controller 202 (step S307). Subsequently, the engine control unit 201 determines whether the computed size of the transfer medium 2 is significantly less than a minimum size of a transfer medium that is conveyable by the paper output option unit 30, that is, the engine control unit 201 determines whether a difference between the computed size of the transfer medium 2 and the minimum size of a transfer medium that is conveyable by the paper output option unit 30 is within a predetermined range (step S310). If a difference between the computed size of the transfer medium 2 and the minimum size of a recording medium that is conveyable by the paper output option unit 30 is within a predetermined range, the engine control unit 201 completes the transfer-medium size detection sequence. However, if the computed size of the transfer medium 2 is significantly less than the minimum size that is conveyable by the paper output option unit 30, the processing of the engine control unit 201 proceeds to step S310. The engine control unit 201 sends transfer-medium size mismatch information to the controller 202 (step S311). Thus, the controller 202 determines that a print failure of the transfer medium 2 occurred. The operations of the image forming apparatus and the paper output option unit 30 are stopped (step S314). Thereafter, the engine control unit 201 sends the size of the transfer medium 2 and the transfer medium number to the controller 202 (step S312). The controller 202 sends the size of the transfer medium 2 and the transfer medium number to the paper output option unit 30 (step S313).

In this way, the paper output option unit 30 can appropriately set a conveyance speed, a conveyance timing, and a jam determination timing for the transfer medium 2 in accordance with the received size of the transfer medium 2 and the transfer medium number. That is, since the paper output option unit 30 can associate the conveyed transfer medium 2 with the size information about the transfer medium 2, the paper output option unit 30 can set a jam determination timing for the transfer medium 2 in accordance with a conveyance speed, a conveyance timing, and the size of the transfer medium 2.

FIG. 14 is a flow chart of an example process performed by the engine control unit 201 in which, during duplex printing, the size of the transfer medium 2 is detected, but the detected size is not sent to the paper output option unit 30. To carry out this process, a CPU (not shown) of the engine control unit 201 reads out a control program from a ROM (not shown) and executes the control program.

The process is described in detail next with reference to FIG. 14. When the transfer medium 2 is fed, the engine control unit 201 receives a transfer medium number corresponding to the transfer medium 2 from the controller 202 (step S321) and starts feeding the transfer medium 2 (step S322). Subsequently, the engine control unit 201 determines the time to resume conveyance of the transfer medium 2 (step S323). In the case of duplex printing, when the time to resume the conveyance of a transfer medium 2 is reached, the processing is completed without detecting the size of the transfer medium 2. In the case of duplex printing, the size of the transfer medium 2 has already been detected before an image is formed on a first surface of the transfer medium 2. Accordingly, a size detecting operation is not needed. When outputting the transfer medium 2 to the paper output option unit 30, the engine control unit 201 starts a timer count (step S324). The transfer medium 2 is then conveyed. When the sensor 19 detects the passage of the trailing edge of the transfer medium 2 (step S327) (see FIG. 18C), the engine control unit 201 stops the timer count (step S328). Subsequently, the engine control unit 201 computes the size of the conveyed transfer medium 2 on the basis of a curved value when the transfer medium 2 is temporarily stopped by a roller 28, a distance between the sensor 19 and the roller 28, and a timer count value (step S328). If the sensor 19 cannot detect the trailing edge of the transfer medium 2 even when a time corresponding to a maximum size of a transfer medium that is conveyable by the paper output option unit 30 has elapsed (step S325), the engine control unit 201 sends transfer-medium mismatch information to the controller 202 (step S326). Thereafter, the engine control unit 201 determines whether the computed size of the transfer medium 2 is significantly less than a minimum size of a transfer medium that is conveyable by the paper output option unit 30, that is, whether a difference between the computed size of the transfer medium 2 and the minimum size of a transfer medium that is conveyable by the paper output option unit 30 is within a predetermined range (step S329). If the difference between the computed size of the transfer medium 2 and the minimum size of a transfer medium that is conveyable by the paper output option unit 30 is within the predetermined range, the engine control unit 201 completes the transfer-medium size detection sequence. If the computed size of the transfer medium 2 is significantly less than the minimum size of a transfer medium that is conveyable by the paper output option unit 30, the processing of the engine control unit 201 proceeds to step S330. The engine control unit 201 sends transfer-medium size mismatch information to the controller 202 (step S330). At that time, the controller 202 determines that a print failure of the transfer medium 2 occurred. The operations of the image forming apparatus and the paper output option unit 30 are stopped (step S334). Thereafter, the engine control unit 201 determines whether the output port for the transfer medium 2 is a duplex printing port (step S331). If the output port for the transfer medium 2 is not a duplex printing port, the engine control unit 201 sends the size of the transfer medium 2 and the transfer medium number to the controller 202 (step S332). The controller 202 sends the size of the transfer medium 2 and the transfer medium number to the paper output option unit 30 (step S333).

In this way, the paper output option unit 30 can appropriately set a conveyance speed, a conveyance timing, and a jam determination timing for the transfer medium 2 in accordance with the received size of the transfer medium 2 and the transfer medium number. That is, since the paper output option unit 30 can associate the conveyed transfer medium 2 with the size information about the transfer medium 2, the paper output option unit 30 can set a jam determination timing for the transfer medium 2 in accordance with a conveyance speed, a conveyance timing, and the size of the transfer medium 2.

Note that, in the present embodiment, the term "size (length) of a transfer medium" refers to the length of a transfer medium in a direction in which the transfer medium is conveyed for forming an image.

The paper output option unit is a paper handling unit. For instance, the paper handling unit includes stapler, booklet maker, and folder.

Other Exemplary Embodiments

In addition to the above-described embodiments, the following embodiments can be made.

Except for hardware having a network function, the above-described embodiments can be realized by software that sequentially performs the above-described data processing. That is, the above-described embodiments of the present invention can be realized by supplying a storage medium (or a recoding medium) storing software program code that achieves the functions of the above-described embodiments to a system or an apparatus and by causing a computer (central processing unit (CPU) or micro-processing unit (MPU)) of the system or apparatus to read and execute the software program code. In such a case, the program code itself read out of the storage medium realizes the functions of the above-described embodiments. The program code can be stored in a variety of storage media, such as a CD (compact disc), an MD (magnetic disk), a memory card, an MO (magneto optical) disc or the like.

Furthermore, the functions of the above-described embodiments can be realized by another method in addition to executing the program code read out by the computer. For example, the functions of the above-described embodiments can be realized by a process in which an operating system (OS) running on the computer executes some of or all of the functions in the above-described embodiments under the control of the program code.

The present invention can also be achieved by writing the program code read out of the storage medium to a memory of an add-on expansion board of a computer or a memory of an add-on expansion unit connected to a computer. The functions of the above-described embodiments can be realized by a process in which, after the program code is written, a CPU in the add-on expansion board or in the add-on expansion unit executes some of or all of the functions in the above-described embodiments under the control of the program code.

While the foregoing embodiments have been described with reference to an image forming apparatus serving as a laser printer, the present invention is applicable to an image forming apparatus serving as a copier having a copy function, an image scanning apparatus having only an image scanning function, a multi-function printer or the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-163823 filed Jun. 13, 2006, which is hereby incorporated by reference herein in its entirety.

What is claimed is:

1. An image forming system comprising:

an image forming unit configured to form an image;

a paper output option unit configured to output a sheet on which an image is formed by the image forming unit;

a detecting unit configured to detect the size of a sheet in a direction in which the sheet is conveyed to the image forming unit;

a controller configured to specify a paper output port of the paper output option unit to output a sheet of a preset size; and wherein the controller determines whether there is a paper output port of the paper output option unit capable of outputting a sheet of a size larger than the preset size in order to continue the image forming operation, in response to sheet size mismatch information indicating that the size of the sheet detected by the detecting unit is larger than the preset size, before the detection of the size of the transfer medium is completed, and changes the specification from the specified paper output port to the paper output port capable of outputting a sheet of the size larger than the preset size.

2. An image forming apparatus, to which a paper output option unit including a plurality of paper output ports is connected, the image forming apparatus comprising:

an image forming unit configured to form an image;

a detecting unit configured to detect the size of a sheet in a direction in which the sheet is conveyed to the image forming unit; and a controller configured to specify a paper output port of the paper output option unit to output a sheet of a preset size, wherein the image forming apparatus sends, to the paper output option unit, information for changing a paper output port to output a preset sheet to a paper output port capable of outputting a sheet larger than the preset sheet, before the detection of the size of the sheet is completed, when the detecting unit detects that the size of a sheet being conveyed is larger than the size of the sheet preset before the size of a sheet is determined

3. An image forming apparatus, to which a paper output option unit including a plurality of paper output ports is connected, the image forming apparatus comprising:

an image forming unit configured to form an image;

a detecting unit configured to detect the size of a sheet in a direction in which the sheet is conveyed to the image forming unit; and a controller configured to specify a paper output port of the paper output option unit to output a sheet of a preset size, wherein the image forming apparatus sends, to the paper output option unit, information for changing a paper output port to output a preset sheet to a paper output port capable of outputting a sheet larger than the preset sheet before a trailing end of the sheet larger than the preset sheet passes the detecting unit, before the detection of the size of the sheet is completed, when the detecting unit detects that the size of a sheet being conveyed is larger than the size of the preset sheet.

* * * * *